US007393070B2

(12) United States Patent
Arazaki

(10) Patent No.: US 7,393,070 B2
(45) Date of Patent: Jul. 1, 2008

(54) PRINTING DEVICE, PRINTING DEVICE CONTROL, PROGRAM AND METHOD, AND PRINTING DATA GENERATION DEVICE, PROGRAM AND METHOD

(75) Inventor: Shinichi Arazaki, Suwa (JP)

(73) Assignee: Seiko Epson Corporation (JP)

( * ) Notice: Subject to any disclaimer, the term of this patent is extended or adjusted under 35 U.S.C. 154(b) by 262 days.

(21) Appl. No.: 11/301,087

(22) Filed: Dec. 12, 2005

(65) Prior Publication Data

US 2006/0125860 A1 Jun. 15, 2006

(30) Foreign Application Priority Data

Dec. 13, 2004 (JP) ..... 2004-359542
Sep. 9, 2005 (JP) ..... 2005-261827

(51) Int. Cl.
*B41J 29/38* (2006.01)

(52) U.S. Cl. ..... 347/5; 347/4; 347/9

(58) Field of Classification Search ..... 347/19, 347/4, 14, 15, 41, 5, 9, 10; 358/1.9
See application file for complete search history.

(56) References Cited

U.S. PATENT DOCUMENTS

| | | | | |
|---|---|---|---|---|
| 6,283,571 | B1 | 9/2001 | Zhou et al. | |
| 6,293,643 | B1 | 9/2001 | Shimada et al. | |
| 6,328,404 | B1 | 12/2001 | Fujimori | |
| 6,908,176 | B2 | 6/2005 | Koitabashi | |
| 6,942,308 | B2 * | 9/2005 | Molinet et al. | 347/4 |
| 7,075,677 | B1 * | 7/2006 | Silverbrook | 358/1.9 |
| 2003/0085939 | A1 | 5/2003 | Koitabashi | |

FOREIGN PATENT DOCUMENTS

| | | |
|---|---|---|
| JP | 01-235655 | 9/1989 |
| JP | 05-030361 | 2/1993 |
| JP | 05-092559 | 4/1993 |
| JP | 05-269990 | 10/1993 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2002-019101 | 1/2003 |
| JP | 2003-063043 | 3/2003 |
| JP | 2003-136702 | 5/2003 |

* cited by examiner

*Primary Examiner*—Lam S Nguyen
(74) *Attorney, Agent, or Firm*—Harness, Dickey & Pierce, P.L.C.

(57) ABSTRACT

A printing device including: an image data acquisition unit acquiring image data corresponding to pixels of the image; a printing data generation unit generating, based on the acquired image data, printing data including information about dot formation details based on the pixels for each of the nozzles; a nozzle information storage unit storing information about nozzles whose dot formation details are different from predetermined dot formation details; and a printing unit printing, based on the printing data, the image onto a printing medium using a printing head. By referring to the nozzle information storage unit, the printing data generation unit generates printing data providing a lower resolution for the image to be printed by at least either the nozzle of different dot formation details or neighboring nozzles compared with a resolution of the image data acquired by the image data acquisition unit corresponding to the nozzle used for printing.

10 Claims, 13 Drawing Sheets

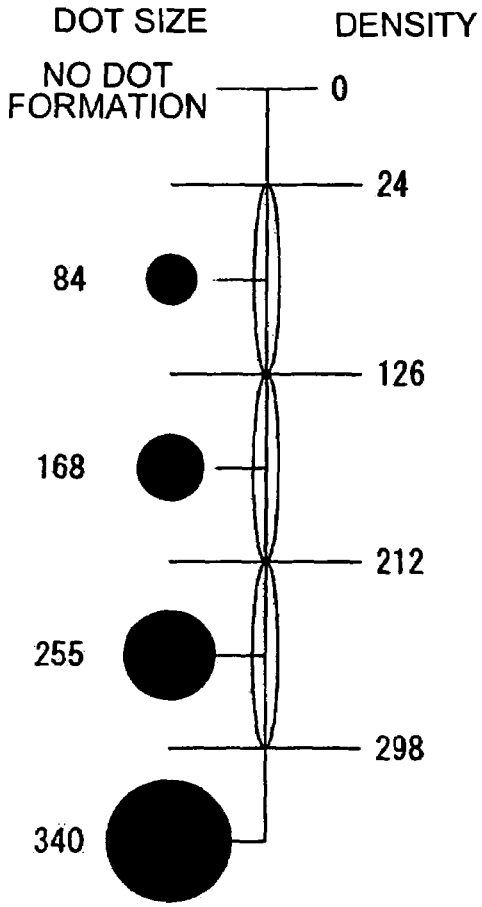
FIG.10
FIG.11A
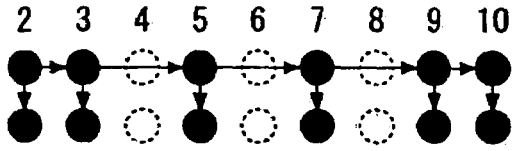
FIG.11B
| | | |
|---|---|---|
| | TAR-GET PIXEL | 7/16 |
| 3/16 | 5/16 | 1/16 |

PRINTING DEVICE, PRINTING DEVICE CONTROL, PROGRAM AND METHOD, AND PRINTING DATA GENERATION DEVICE, PROGRAM AND METHOD

RELATED APPLICATIONS

This application claims priority to Japanese Patent Application Nos. 2004-359542 filed Dec. 13, 2004 and 2005-261827 filed Sep. 9, 2005 which are hereby expressly incorporated by reference herein in their entirety.

BACKGROUND

1. Technical Field

The present invention relates to a printing device, a printing device control program and method, and a printing data generation device, program, and method for use with printers of facsimile machines, copying machines, OA equipment, and others. More specifically, the present invention is suitable for use with a printing device of an ink jet type that is capable of text and image rendering onto a printing paper. (printing medium) through discharge of liquid ink particles of various colors, a control program and method for such a printing device, and a printing data generation device, program, and method.

2. Related Art

Described below is a printing device, specifically a printer of an ink jet type (hereinafter, referred to as ink jet printer").

Because ink jet printers are relatively inexpensive and they easily achieve high-quality color printing, ink jet printers have become widely popular not only for office use but also for personal use particularly with the spread of personal computers, digital cameras, and the like.

Such an ink jet printer generally performs text and image rendering on a printing medium (paper) using a moving element in a predetermined manner so that any desired printing is achieved. More in detail, the moving element referred to as a carriage includes an ink cartridge and a printing head as a piece, reciprocating relative to the printing medium in a direction perpendicular to the paper feeding direction, and discharging (ejecting) liquid ink droplets in the form of dots from the nozzles provided to the printing head. If the carriage is provided with ink cartridges of four colors, i.e., black, yellow, magenta, and cyan, and each corresponding printing head, full-color printing becomes possible in addition to monochrome printing by color mixture. Better still, ink cartridges of six, seven, or eight colors additionally with light cyan, light magenta, and others are also in practical use.

There is a problem with ink jet printers that perform printing with the printer head reciprocating on the carriage in the direction perpendicular to the printing paper. That is, to derive a clearly-printed page, the printing head requires frequent reciprocating movements, e.g., several tens to a hundred or more. This results in a drawback of a longer printing time as compared with other types of printing devices such as electrophotographic laser printers or others, e.g., copying machines. Note here that ink jet printers of this type are generally referred to as "multi-path printers" or "serial printers".

On the other hand, with an ink jet printer that does not use a carriage but rather a long printing head having the same width as that of the printing paper or longer, there is no need to move the printing head in the width direction of the printing paper. This accordingly allows printing with a single scan, i.e., a single path, favorably leading to high-speed printing as with laser printers. What is better, this eliminates the need for a carriage with a printing head, and a drive system for moving the carriage, thereby reducing the size and weight of the cabinet of the printer, and the noise to a considerable degree. Note here that ink jet printers of this type are generally referred to as "line-head printers".

The issue with such ink jet printers is the manufacturing deviation observed in the printing head that serves an essential role for the printer. The manufacturing deviation results from the configuration of the printing head, carrying very small nozzles of about 10 to 70 μm in diameter in a line at regular intervals, or in a plurality of lines in the printing direction. In such a configuration, a nozzle may be partially misaligned so that the ink discharge direction is incorrectly angled, or the nozzles may not be correctly disposed as they are expected to be so that the nozzles resultantly fail in forming dots at their ideal positions, i.e., ink deflection. Because the nozzles often show a wide range of variation in the ink amount, if the variation is too much, the ink amount to be discharged from the nozzle is considerably large or small compared with the ideal amount of ink.

As a result, an image part printed by such a faulty nozzle suffers a printing failure, i.e., a so-called banding (streaking) problem, resultantly reducing the printing quality considerably. More in detail, with ink deflection, the dot-to-dot distance between dots formed by any adjacent nozzles becomes non-uniform. When such a dot-to-dot distance is longer than usual, the corresponding part suffers from white streaks when the printing paper is white in color. When the dot-to-dot distance is shorter than usual, the corresponding part suffers from dark streaks. When the amount of ink coming from any of the nozzles is not ideal and is a lot, the part for the nozzle suffers from dark streaks, and when the amount of ink is little, the part suffers from white streaks.

Such a banding problem is often observed in "line head printers" in which a printing head or a printing medium is fixed, i.e., printing with a single scan, compared with the above-described "multi-path printers" (serial printers) This is because the multi-path printers are adopting the technology of making white streaks less noticeable utilizing frequent reciprocating movements of the printing head.

For the purpose of preventing printing failures caused by the banding problem, research and development has been actively conducted from the hardware perspective, e.g., improving the manufacturing technology of the printing head, or improving the design thereof. However, from the perspective of manufacturing cost, the printing quality, the technology, or others, it is found difficult to provide a printing head perfectly free from the banding problem.

In consideration of the above, the currently-available technology for correcting the banding problem is adopting a so-called software technique such as printing control as described below in addition to such improvements from the hardware perspective as described above.

As an example for such a technology, Patent Document 1 (JP-A-2002-19101) and Patent Document 2 (JP-A-2003-136702) describe the technology as a measure against the ink amount variation of the nozzles, and ink discharge failures. More in detail, parts of lower density are applied with shading correction so that any head variation is handled, and parts of higher density are provided with substitution color, e.g., cyan or magenta for printing in black, so that the banding problem is corrected or any ink amount variation is made less noticeable.

Patent Document 3 (JP-A-2003-63043) describes the technology of generating filled-in images, i.e., images being solidly and completely filled, using all provided nozzles. That is, for filled-in images, any nozzles in the vicinity of pixels in charge of any discharge-faulty nozzle(s) are increased in ink amount for discharge.

Patent Document 4 (JP-A-5-30361) describes the technology of preventing the banding problem with a process of feeding back any variation observed to the ink amount coming from the nozzles through error diffusion so that the variation is absorbed.

The concern here is that, with the technology of correcting the banding problem or reducing the variation of nozzles using substitution colors as related arts found in Patent Document 1 and 2, any processed parts are changed in hue. In consideration thereof, such technologies are not suitable for printing required to be high in image quality and printing quality as color photograph printing.

Another issue is with the technology of allocating information about any discharge-faulty nozzles to the right and left thereof to prevent white streaks in parts high in density. If this technology is applied to solve the above-described ink deflection problem, white streaks are actually reduced but the banding problem still remains unsolved in parts high in density.

The related art of Patent Document 3 causes no problem with printing subjects if they are filled-in images, but cannot be used if printing subjects are of halftone. The technology of using substitution colors may serve well for thin lines. However, if with an image of many colors, i.e., one color next to another, the technology also fails to solve the problem of hue change in the image.

The related art of Patent Document 4 also raises an issue of complicating the feeding-back process that is expected to be appropriately executed against the problem of not deriving ideal dot formation details, and such an issue is difficult to solve.

SUMMARY

An advantage of some aspects of the invention is to provide a printing device, a printing device control program and method, and a printing data generation device, program, and method, all of which are newly developed and capable of stopping image degradation or making image degradation less conspicuous that is caused by a banding problem resulting from ink deflection, and ink discharge failures.

First Aspect

A first aspect of the invention is directed to a printing device that prints a predetermined image onto a printing medium using a printing head that includes a plurality of nozzles each capable of dot formation to the printing medium. The printing device includes: an image data acquisition unit that acquires image data corresponding to a plurality of pixels of the image; a printing data generation unit that generates, based on the acquired image data, printing data including information about dot formation details based on the pixels for each of the nozzles; a nozzle information storage unit that stores information about any of the nozzles whose dot formation details are different from predetermined dot formation details; and a printing unit that prints, based on the printing data, the image onto the printing medium using the printing head. In the printing device, by referring to the nozzle information storage unit for storage details therein, the printing data generation unit generates the printing data providing a lower resolution for the image to be printed by at least either the nozzle of different dot formation details or any of the other neighboring nozzles compared with a resolution of the image data acquired by the image data acquisition unit corresponding to the nozzle used for printing.

With such a configuration, the image data acquisition unit can acquire image data corresponding to a plurality of pixels. The printing data generation unit can generate, based on the acquired image data, printing data including information about dot formation details based on the pixels of the image data for each of the nozzles. The printing data generation unit can generate printing data including information about dot formation details based on the pixels for each of the nozzles. The nozzle information storage unit can store information about any of the nozzles whose dot formation details are different from predetermined dot formation details. The printing unit can print, based on the printing data, the image of the image data onto the printing medium using the printing head.

By referring to the nozzle information storage unit for storage details therein, the printing data generation unit can generate the printing data providing a lower resolution for the image to be printed by at least either the nozzle of different dot formation details or any of the other neighboring nozzles compared with the original resolution of the image corresponding to the nozzle used for printing.

As such, by reducing the resolution of an image to be printed by at least either the nozzle of different dot formation details or any of the other neighboring nozzles, effectively, white or dark streaks can be made less noticeable. The white and dark streaks are those caused by a banding problem, which results from ink deflection due to nozzles varying in dot formation details, for example.

Herein, the expression "the information about dot formation details for each of the nozzles" includes information needed for dot formation using nozzles. For example, the information is about whether or not to form dots using nozzles with respect to pixel values of image data. If dots are to be formed, the information is also about dot size of large, medium, or small, for example. This is not restrictive, and when there is only one dot size, the information may be only about whether or not to form dots.

The expression "banding problem" means two types of printing failures. One is a printing failure of white and dark streaks observed together in the printing result. This results from ink deflection due to nozzles varying in dot formation details. The other is a printing failure caused by varying ink discharge amount. This is applicable to aspects of "printing device control program", "printing device control method", "printing data generation device", "printing data generation program", "printing data generation method", and "program-recorded recording medium", descriptions in the "description of exemplary embodiments", and others.

The expression "ink deflection" means a phenomenon in which, unlike the mere ink discharge failures occur to some of the nozzles, the nozzles have no problem for ink discharge but are partially misaligned so that the ink discharge direction is incorrectly angled, thereby failing in forming dots at their ideal positions. This is applicable to aspects of "printing device control program", "printing device control method", "printing data generation device", "printing data generation program", "printing data generation method", and "program-recorded recording medium", descriptions in the "description of exemplary embodiments", and others.

The expression "white streaks" denotes the parts (regions) of a printing medium whose base appears streaky in color. This is due to the ink deflection, resultantly causing the dot-to-dot distance between any adjacent dots to be often wider than a predetermined distance. The expression "dark streaks" denotes the parts (regions) of a printing medium whose base is not visible in color or looks relatively darker due to also the ink deflection, resultantly causing the dot-to-dot distance between any adjacent dots to be often narrower than the predetermined distance. The expression "dark streaks" also denotes the parts (regions) of a printing medium that look streaky dark in color, caused by dots not formed at their ideal positions by being overlaid on dots formed at their normal positions. The white streaks may occur due to nozzles whose ink discharge amount is less than others, and the dark streaks may occur due to nozzles whose ink discharge amount is more than others. This is applicable to aspects of "printing device control program", "printing device control method", "printing data generation device", "printing data generation program", "printing data generation method", and "program-recorded recording medium", descriptions in the "description of exemplary embodiments", and others.

The expression "storage details" of the nozzle information storage unit denotes information about nozzle(s) whose dot formation details are different from any predetermined formation details. The information may be stored in various manners, and as an example, nozzle information such as ink deflection level or ink discharge amount may be stored as it is, and the information is compared with any preset threshold value in the flow process. Alternatively, the number of stages for correction may be replaced with the number of steps, and the resulting number of steps may be stored. On/Off information about whether the nozzle can be used or not may be solely used for processing. This is applicable to aspects of "printing device control program", "printing device control method", "printing data generation device", "printing data generation program", "printing data generation method", "program-recorded recording medium", and descriptions in the "description of exemplary embodiments", and others.

The expression "nozzles of different dot formation details or any of the other neighboring nozzles" includes, when the white streaks occur, any nozzles whose dot formation details differ from others due to ink deflection, and any nozzles forming normal dots with the wider dot-to-dot distance from dots formed by the nozzles of different dot formation details. When the dark streaks occur, the expression includes any nozzles whose dot formation details differ from others due to also ink deflection, and any nozzles forming normal dots with the narrower dot-to-dot distance from dots formed by the nozzles of different dot formation details, or forming normal dots being partially or entirely overlaid on one another. This is applicable to aspects of "printing device control program", "printing device control method", "printing data generation device", "printing data generation program", "printing data generation method", and "program-recorded recording medium", descriptions in the "description of exemplary embodiments", and others.

The expression "different from predetermined dot formation details" denotes various states as described below. That is, the state in which dots formed by a nozzle(s) are not at their ideal positions, the state in which dots formed by a nozzle(s) are misaligned and away from their ideal positions by a predetermined distance or more, the state in which dots formed by a nozzle(s) are smaller or larger than their ideal size, or the state in which dots formed by a nozzle(s) are smaller or larger considerably than their ideal size by a predetermined size or more. Specifically when formed dots are greatly away from their ideal positions, the above-described ink deflection occurs.

The expression "dot" denotes a basic unit that represents texts and graphics of a printing subject, being a single region of a printing medium including an ink droplet discharged from one or more nozzles. This "dot" is not zero in area, is of a predetermined size (area), and is of various sizes. The dot is not necessarily a perfect circle in shape, and may take any other shape such as an ellipse. With this being the case, the diameter may not always be the same, and the dot size is thus determined by the area occupied by the dot or by the average dot diameter. This is applicable to aspects of "printing device, "printing device control program", "printing device control method", "printing data generation device", "printing data generation program", "printing data generation method", and "program-recorded recording medium", descriptions in the "description of exemplary embodiments", and others.

Defining the expression "dot diameter" more precisely, as to a perfect circle having the same area as a dot formed with a certain amount of ink, an equivalent dot is estimated, and the diameter of the estimated equivalent dot is dealt as the dot diameter. The ink absorption rate generally varies depending on the types of the printing medium, and thus no matter if with the same amount of ink, the dot diameter surely varies with different printing medium. What is more, the expression "dot" is not limited to a dot formed by a single ink droplet discharged from a single nozzle, and includes a super-large dot formed by two or more ink droplets.

The expression "any of the other neighboring nozzles" denotes, although not in a strict sense, a nozzle(s) taking charge of about 10 pixels around pixels taken charge by the nozzle of different dot formation details, for example. This is because, if this vicinity range is too wide, it resultantly increases the not-that-good granularity. With some level of image resolution, too much pinpoint precision will make the corresponding part peculiar. The gradual pixel decimation is thus considered preferable.

Although there is no specific way to determine "either the nozzle of different dot formation details or any of the other neighboring nozzles by the printing data generation unit", determining any nozzles not causing printing misalignment as nozzles for use is considered appropriate, for example. Alternatively, the nozzle determination may be made for each line or every few lines, made by any specific pattern, or made at random.

Second Aspect

According to a printing device of a second aspect, in the first aspect, with respect to values of the pixels of the image data corresponding to the nozzle of different dot formation details and any of the other neighboring nozzles, the printing data generation unit selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration enables not only making white or dark streaks caused by a banding problem less noticeable but also to effectively prevent images of a printing result from lowering image quality. This is achieved by changing the position of a not-to-be-used nozzle(s) on a line basis as a measure to prevent dots from collectively missing from any specific line.

Third Aspect

According to a printing device of a third aspect, in the first or second aspect, with respect to values of the pixels of the image data corresponding to the nozzle of different dot formation details and any of the other neighboring nozzles, the printing data generation unit selects, from a predetermined line position of the image, the nozzle of different dot formation details and any of the neighboring nozzles for exclusion for use with printing the image of the image data.

By selecting any not-to-be-used nozzle for every odd- or even-numbered line of an image, for example, such a configuration enables not only making white or dark streaks caused by a banding problem less noticeable but also to effectively prevent images of a printing result from lowering image quality to a greater degree than selecting any not-to-be-used nozzle for every line.

Fourth Aspect

According to a printing device of a fourth aspect, in the second aspect, when selecting any of the other neighboring nozzles for exclusion for use, the printing data generation unit makes the selection from a random position for every line of the image.

By making any nozzle not available for use from a random position for every line of an image, for example, such a configuration enables not only making white or dark streaks caused by a banding problem less noticeable but also to effectively prevent images of a printing result from lowering image quality to a greater degree than making any specific nozzle at the same position not available for use.

Fifth Aspect

According to a printing device of a fifth aspect, in any one of the second to fourth aspects, the printing data generation unit selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration enables not only making white or dark streaks caused by a banding problem less noticeable but also to effectively reduce the resolution without requiring any specific image processing. This is achieved by treating pixels corresponding to any not-to-be-used nozzle as if they had not been existed, i.e., no processing with such pixels.

Sixth Aspect

According to a printing device of a sixth aspect, in any one of the second to fifth aspects, the printing data generation unit selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration enables not only making white or dark streaks caused by a banding problem less noticeable but also to effectively reduce the resolution without requiring any specific image processing. This is achieved by treating pixels corresponding to any not-to-be-used nozzle as if they had not been existed, i.e., no processing with such pixels.

Seventh Aspect

According to-a printing device of a seventh aspect, in any one of the first to sixth aspects, the printing data generation unit generates the printing data in which a portion of the image to be printed with the lower resolution shows a dithering level equivalent to that of the image before the resolution is reduced.

Such a configuration enables not only making white or dark streaks caused by a banding problem less noticeable but also to keep the same dithering level of an image before and after the resolution is reduced so that images of a printing result can be effectively prevented from lowering image quality even after the resolution is reduced.

Eighth Aspect

According to a printing device of an eighth aspect, in the seventh aspect, the printing data generation unit generates the printing data in which a dot to be formed by at least either the nozzle of different dot formation details or any of the other neighboring nozzles is larger in size than a dot before the resolution is reduced with respect to the values of the pixels of the image data corresponding to the nozzle.

Such a configuration enables not only making white or dark streaks caused by a banding problem less noticeable but also to effectively prevent images of a printing result from lowering image quality even after the resolution is reduced. This is achieved by increasing the size of dots to be formed by printing nozzles as a measure to suppress the reduction of a dithering level caused by pixels formed with no dots.

Ninth Aspect

According to a printing device of a ninth aspect, in the seventh or eighth aspect, based on values of the pixels of the image data corresponding to the nozzles for exclusion for use, the printing data generation unit corrects the values of the pixels of the image data corresponding to any of the nozzles adjacent to the nozzles for exclusion for use, and generates the printing data based on the values of the pixels of the corrected image data.

Such a configuration enables to suppress the reduction of a dithering level caused by defect pixels corresponding to any not-to-be-used nozzle so that the images of a printing result can be prevented from lowering image quality even after the resolution is reduced.

Tenth Aspect

According to a printing device of a tenth aspect, in any one of the first to ninth aspects, the printing head is configured by the nozzles successively disposed over a region wider than a region with the printing medium being attached.

With such a configuration, as described above, white and dark streaks can be effectively made less noticeable. These streaks are those caused by a banding problem, which is often observed in line head printing heads that complete printing with a single path.

Eleventh Aspect

According to a printing device of an eleventh aspect, in any one of the first to ninth aspects, the printing head is configured by the nozzles disposed in a direction perpendicular to a paper feeding direction of the printing medium for printing with a single scan.

With such a configuration, as described above, white and dark streaks can be effectively eliminated or made less noticeable. These streaks are those caused by a banding problem, which is often observed in line head printing heads that complete printing with a single scan, i.e., a single path.

Herein, the expression "printing with a single scan" denotes a printing operation in which lines are printed by each corresponding nozzle in the paper feeding direction, i.e., direction along which a printing head moves, and when the nozzles pass through their lines, the printing operation is through for the lines. This is applicable to aspects of "printing device control program", "printing device control method", "printing data generation device", "printing data generation program", "printing data generation method", and "program-recorded recording medium", descriptions in the "description of exemplary embodiments", and others.

Twelfth Aspect

According to a printing device of a twelfth aspect, in any one of the first to ninth aspects, the printing head takes charge of printing while reciprocating in a direction perpendicular to a paper feeding direction of the printing medium.

The above-described banding problem is relatively common with printing heads of line head type, but printing heads of multi-path type are not yet free from such a problem. In view thereof, by applying the printing device of any one of the first to eighth aspects to the printing heads of multi-path type, white or dark streaks caused by a banding problem can be effectively made less noticeable in the printing result derived by the printing heads of multi-path type.

With the printing heads of multi-path type, the above-described banding problem can be prevented by repeated image scanning using the printing head, for example. However, using the printing device of any one of the first to ninth aspects favorably eliminates such a need to repeatedly perform image scanning using the printing head, and the higher-speed printing can be implemented.

Thirteenth Aspect

A thirteenth aspect of the invention is directed to a printing device control program for use of controlling a printing device that prints a predetermined image onto a printing medium using a printing head that includes a plurality of nozzles each capable of dot formation to the printing medium. The control program includes, for process execution by a computer: acquiring image data corresponding to a plurality of pixels of the image; generating, based on the acquired image data, printing data including information about whether a dot is to be formed or not for each of the pixels; and printing, based on the printing data, the image onto the printing medium using the printing head. In the printing device control program, by referring to a nozzle information storage unit for storage details of information about any of the nozzles whose dot formation details are different from predetermined dot formation details, the generating generates the printing data providing a lower resolution for the image to be printed by at least either the nozzle of different dot formation details or any of the other neighboring nozzles compared with a resolution of the image data acquired by an image data acquisition unit corresponding to the nozzle used for printing.

Such a configuration leads to effects and advantages similar to the printing device of the first aspect by a computer reading a program and executing processes in accordance with the program.

Printing devices on the current market such as ink jet printers are each provided with a computer system, which is configured to include a Central Processing Unit (CPU), a storage device (Random Access Memory (RAM), Read Only Memory (ROM)), an input/output device, or others. Using such a computer system, the processes can be implemented by software. The printing device control program thus can implement the processes more economically and with more ease than a case with hardware that is specifically built for this purpose.

Moreover, through partial rewriting of the program, it leads to easy version up by function modification or improvement, for example.

Fourteenth Aspect

According to a printing device control program of a fourteenth aspect, in the thirteenth aspect, with respect to values of the pixels of the image data corresponding to the nozzle of different dot formation details and any of the other neighboring nozzles, the generating selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration leads to effects and advantages similar to the printing device of the second aspect by a computer reading a program and executing processes in accordance with the program.

Fifteenth Aspect

According to a printing device control program of a fifteenth aspect, in the thirteenth or fourteenth aspect, with respect to values of the pixels of the image data corresponding to the nozzle of different dot formation details and any of the other neighboring nozzles, the generating selects, from a predetermined line position of the image, the nozzle of different dot formation details and any of the neighboring nozzles for exclusion for use with printing the image of the image data.

Such a configuration leads to effects and advantages similar to the printing device of the third aspect by a computer reading a program and executing processes in accordance with the program.

Sixteenth Aspect

According to a printing device control program of a sixteenth aspect, in the fourteenth aspect, when selecting any of the other neighboring nozzles for exclusion for use, the generating makes the selection from a random position for every line of the image.

Such a configuration leads to effects and advantages similar to the printing device of the fourth aspect by a computer reading a program and executing processes in accordance with the program.

Seventeenth Aspect

According to a printing device control program of a seventeenth aspect, in any one of the fourteenth to sixteenth aspects, the generating selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration leads to effects and advantages similar to the printing device of the fifth aspect by a computer reading a program and executing processes in accordance with the program.

Eighteenth Aspect

According to a printing device control program of an eighteenth aspect, in any one of the fourteenth to seventeenth aspects, the generating selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration leads to effects and advantages similar to the printing device of the sixth aspect by a computer reading a program and executing processes in accordance with the program.

Nineteenth Aspect

According to a printing device control program of a nineteenth aspect, in any one of the thirteenth to eighteenth aspects, the generating generates the printing data in which a portion of the image to be printed with the lower resolution shows a dithering level equivalent to that of the image before the resolution is reduced.

Such a configuration leads to effects and advantages similar to the printing device of the seventh aspect by a computer reading a program and executing processes in accordance with the program.

Twentieth Aspect

According to a printing device control program of a twentieth aspect, in the nineteenth aspect, the generating generates the printing data in which a dot to be formed by at least either the nozzle of different dot formation details or any of the other neighboring nozzles is larger in size than a dot before the resolution is reduced with respect to the values of the pixels of the image-data corresponding to the nozzle.

Such a configuration leads to effects and advantages similar to the printing device of the eighth aspect by a computer reading a program and executing processes in accordance with the program.

Twenty-first Aspect

According to a printing device control program of a twenty-first aspect, in the nineteenth or twentieth aspect, based on values of the pixels of the image data corresponding to the nozzles for exclusion for use, the generating corrects the values of the pixels of the image data corresponding to any of the nozzles adjacent to the nozzles for exclusion for use, and generates the printing data based on the values of the pixels of the corrected image data.

Such a configuration leads to effects and advantages similar to the printing device of the ninth aspect by a computer reading a program and executing processes by following the program.

Twenty-second Aspect

A twenty-second aspect of the invention is directed to a computer-readable printing-device-control-program-recorded recording medium that is recorded with the printing device control program of any one of the thirteenth to twenty-first aspects.

This leads to effects and advantages similar to the printing device control program of any one of the thirteenth to twenty-first aspects, and enables easy provision of the printing program via recording media such as CD-ROMs, DVD-ROMs, and MOs.

Twenty-third Aspect

A twenty-third aspect of the invention is directed to a printing device control method for use of controlling a printing device that prints a predetermined image onto a printing medium using a printing head that includes a plurality of nozzles each capable of dot formation to the printing medium. The control method includes: acquiring image data corresponding to a plurality of pixels of the image; generating, based on the acquired image data, printing data including information about whether a dot is to be formed or not for each of the pixels; and printing, based on the printing data, the image onto the printing medium using the printing head. In the printing device control method, by referring to a nozzle information storage unit for storage details of information about any of the nozzles whose dot formation details are different from ideal dot formation details, the generating generates the printing data providing a lower resolution for the image to be printed by at least either the nozzle of different dot formation details or any of the other neighboring nozzles compared with a resolution of the image data acquired by an image data acquisition unit corresponding to the nozzle used for printing.

More specifically, it is a printing device control method for use of controlling a printing device that prints a predetermined image onto a printing medium using a printing head that includes a plurality of nozzles each capable of dot formation to the printing medium. The control method includes: acquiring image data corresponding to a plurality of pixels of the image (input device); generating (a CPU (Central Processing Unit) takes charge of execution in accordance with a program stored in ROM), based on the acquired image data, printing data including information (to be stored in a secondary storage, and at the time of execution, stored in RAM (main storage)) about whether a dot is to be formed or not for each of the pixels; and printing (executed by the CPU while exercising control over an output device), based on the printing data, the image onto the printing medium using the printing head. In the printing device control method, by referring to a nozzle information storage unit for storage details (to be stored in the secondary storage, and at the time of execution, stored in the RAM) of information about any of the nozzles whose dot formation details are different from predetermined dot formation details, the generating (the CPU takes charge of execution in accordance with the program stored in the ROM) generates the printing data providing a lower resolution for the image to be printed by at least either the nozzle of different dot formation details or any of the other neighboring nozzles compared with a resolution of the image data acquired by an image data acquisition unit corresponding to the nozzle used for printing.

Such a configuration leads to effects and advantages similar to the printing device of the first aspect.

Twenty-fourth Aspect

A twenty-fourth aspect of the invention is directed to a printing device control method, in the twenty-third aspect, with respect to values of the pixels of the image data corresponding to the nozzle of different dot formation details and any of the other neighboring nozzles, the generating selects, for every line of the image, the nozzle of different dot formation details and any of the other neighboring nozzles for exclusion for use with printing the image of the image data, and generates the printing data based on the values of the pixels of the image data corresponding to the selected nozzles.

More specifically, in the twenty-third aspect, with respect to values of the pixels of the image data corresponding to the nozzle of different dot formation details and any of the other neighboring nozzles, the generating (the CPU takes charge of execution in accordance with the program stored in the ROM) selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration leads to effects and advantages similar to the printing device of the second aspect.

Twenty-fifth Aspect

According to a printing device control method of a twenty-fifth aspect, in the twenty-third or twenty-fourth aspect, with respect to values of the pixels of the image data corresponding to the nozzle of different dot formation details and any of the other neighboring nozzles, the generating selects, from a predetermined line position of the image, the nozzle of different dot formation details and any of the neighboring nozzles for exclusion for use with printing the image of the image data.

More specifically, in the twenty-third or twenty-fourth aspect, with respect to values of the pixels of the image data corresponding to the nozzle of different dot formation details and any of the other neighboring nozzles, the generating (the CPU takes charge of execution in accordance with the program stored in the ROM) selects, from a predetermined line position of the image, the nozzle of different dot formation details and any of the neighboring nozzles for exclusion for use with printing the image of the image data.

Such a configuration leads to effects and advantages similar to the printing device of the third aspect.

Twenty-sixth Aspect

According to a printing device control method of a twenty-sixth aspect, in the twenty-fourth aspect, when selecting any of the other neighboring nozzles for exclusion for use, the generating makes the selection from a random position for every line of the image.

More specifically, in the twenty-fourth aspect, when selecting any of the other neighboring nozzles for exclusion for use, the generating (the CPU takes charge of execution in accordance with the program stored in the ROM) makes the selection from a random position for every line of the image.

Such a configuration leads to effects and advantages similar to the printing device of the fourth aspect.

Twenty-seventh Aspect

According to a printing device control method of a twenty-seventh aspect, in any one of the twenty-fourth to twenty-sixth aspects, the generating selects, for exclusion for use, the nozzle of different dot formation details and any of the neighboring nozzles to alternately switch, for every predetermined line of the image, between two states of using or not using at least either the nozzle of different dot formation details or the neighboring nozzle.

More specifically, in any one of the twenty-fourth to twenty-sixth aspects, the generating (the CPU takes charge of execution in accordance with the program stored in the ROM) selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration leads to effects and advantages similar to the printing device of the fifth aspect.

Twenty-eighth Aspect

According to a printing device control method of a twenty-eighth aspect, in any one of the twenty-fourth to twenty-seventh aspects, the generating selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

More specifically, in any one of the twenty-fourth to twenty-seventh aspects, the generating (the CPU takes charge of execution in accordance with the program stored in the ROM) selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration leads to effects and advantages similar to the printing device of the sixth aspect.

Twenty-ninth Aspect

According to a printing device control method of a twenty-ninth aspect, in any one of the twenty-third to twenty-eighth aspects, the generating generates the printing data in which a portion of the image to be printed with the lower resolution shows a dithering level equivalent to that of the image before the resolution is reduced.

More specifically, in any one of the twenty-third to twenty-eighth aspects, the generating (the CPU takes charge of execution in accordance with the program stored in the ROM) generates the printing data in which a portion of the image to be printed with the lower resolution shows a dithering level equivalent to that of the image before the resolution is reduced.

Such a configuration leads to effects and advantages similar to the printing device of the seventh aspect.

Thirtieth Aspect

According to a printing device control method of a thirtieth aspect, in the twenty-ninth aspect, the generating generates the printing data in which a dot to be formed by at least either the nozzle of different dot formation details or any of the other neighboring nozzles is larger in size than a dot before the resolution is reduced with respect to the values of the pixels of the image data corresponding to the nozzle.

More specifically, the generating (the CPU takes charge of execution in accordance with the program stored in the ROM) generates the printing data in which a dot to be formed by at least either the nozzle of different dot formation details or any of the other neighboring nozzles is larger in size than a dot before the resolution is reduced with respect to the values of the pixels of the image data corresponding to the nozzle.

Such a configuration leads to effects and advantages similar to the printing device of the eighth aspect.

Thirty-first Aspect

According to a printing device control method of a thirty-first aspect, in the twenty-ninth or thirtieth aspect, based on values of the pixels of the image data corresponding to the nozzles for exclusion for use, the generating corrects the values of the pixels of the image data corresponding to any of the nozzles adjacent to the nozzles for exclusion for use, and generates the printing data based on the values of the pixels of the corrected image data.

More specifically, in the twenty-ninth or thirtieth aspect, based on values of the pixels of the image data corresponding to the nozzles for exclusion for use, the generating (the CPU takes charge of execution in accordance with the program stored in the ROM) corrects the values of the pixels of the image data corresponding to any of the nozzles adjacent to the nozzles for exclusion for use, and generates the printing data based on the values of the pixels of the corrected image data.

Such a configuration leads to effects and advantages similar to the printing device of the ninth aspect.

Thirty-second Aspect

A thirty-second aspect of the invention is directed to a printing data generation device that generates printing data for use in a printing device that prints a predetermined image onto a printing medium using a printing head that includes a plurality of nozzles each capable of forming a dot of a predetermined size to the printing medium. The generation device includes: an image data acquisition unit that acquires image data corresponding to a plurality of pixels of the image; a printing data generation unit that generates, based on the acquired image data, printing data including information about whether the dot is to be formed for each of the pixels; and a nozzle information storage unit that stores information about any of the nozzles whose dot formation details are different from ideal dot formation details. In the printing data generation device, by referring to the nozzle information storage unit for storage details therein, the printing data generation unit generates the printing data providing a lower resolution for the image to be printed by at least either the nozzle of different dot formation details or any of the other neighboring nozzles compared with a resolution of the image data acquired by the image data acquisition unit corresponding to the nozzle used for printing.

That is, the thirty-second aspect includes no such printing unit for actual printing as the above-described printing devices, but generates only printing data corresponding to the properties of a printing head based merely on original multi-level image data.

Accordingly, any existing ink jet printing device can be used as it is only by forwarding the generated printing data thereto. What is more, the printing result will be high in quality on which white or dark streaks are made less noticeable similarly to the printing device of the first aspect.

Furthermore, it allows the use of general-purpose information processors such as personal computers, and thus any existing printing system can be used as it is, being configured by a printing command device such as a personal computer, and an ink jet printer.

Thirty-third Aspect

According to a printing data generation device of a thirty-third aspect, in the thirty-second aspect, with respect to values of the pixels of the image data corresponding to the nozzle of different dot formation details and any of the other neighboring nozzles, the printing data generation unit selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration enables to easily derive the printing result high in quality with less noticeable white streaks similarly to the printing device of the second aspect.

Thirty-fourth Aspect

According to a printing data generation device of a thirty-fourth aspect, in the thirty-second or thirty-third aspect, with respect to values of the pixels of the image data corresponding to the nozzle of different dot formation details and any of the other neighboring nozzles, the printing data generation unit selects, from a predetermined line position of the image, the nozzle of different dot formation details and any of the neighboring nozzles for exclusion for use with printing the image of the image data.

Such a configuration enables to easily derive the printing result high in quality with less noticeable white streaks similarly to the printing device of the third aspect.

Thirty-fifth Aspect

According to a printing data generation device of a thirty-fifth aspect, in the thirty-third aspect, when selecting any of the other neighboring nozzles for exclusion for use, the printing data generation unit makes the selection from a random position for every line of the image.

Such a configuration enables to easily derive the printing result high in quality with less noticeable white streaks similarly to the printing device of the fourth aspect.

Thirty-sixth Aspect

According to a printing data generation device of a thirty-sixth aspect, in any one of the thirty-third to thirty-fifth aspects, the printing data generation unit selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration enables to easily derive the printing result high in quality with less noticeable white streaks similarly to the printing device of the fifth aspect.

Thirty-seventh Aspect

According to a printing data generation device of a thirty-seventh aspect, in any one of the thirty-third to thirty-sixth aspects, the printing data generation unit selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration enables to easily derive the printing result high in quality with less noticeable white streaks similarly to the printing device of the sixth aspect.

Thirty-eighth Aspect

According to a printing data generation device of a thirty-eighth aspect, in any one of the thirty-third to thirty-seventh aspects, the printing data generation unit generates the printing data in which a portion of the image to be printed with the lower resolution shows a dithering level equivalent to that of the image before the resolution is reduced.

Such a configuration enables to easily derive the printing result high in quality with less noticeable white streaks similarly to the printing device of the seventh aspect.

Thirty-ninth Aspect

According to a printing data generation device of a thirty-ninth aspect, in the thirty-eighth aspect, the printing data generation unit generates the printing data in which a dot to be formed by at least either the nozzle of different dot formation details or any of the other neighboring nozzles is larger in size than a dot before the resolution is reduced with respect to the values of the pixels of the image data corresponding to the nozzle.

Such a configuration enables to easily derive the printing result high in quality with less noticeable white streaks similarly to the printing device of the eighth aspect.

Fortieth Aspect

According to a printing data generation device of a fortieth aspect, in the thirty-eighth or thirty-ninth aspect, based on values of the pixels of the image data corresponding to the nozzles for exclusion for use, the printing data generation unit corrects the values of the pixels of the image data corresponding to any of the nozzles adjacent to the nozzles for exclusion for use, and generates the printing data based on the values of the pixels of the corrected image data.

Such a configuration enables to easily derive the printing result high in quality with less noticeable white streaks similarly to the printing device of the ninth aspect.

Forty-first Aspect

A forty-first aspect of the invention is directed to a printing data generation program generates printing data for use in a printing device that prints a predetermined image onto a printing medium using a printing head that includes a plurality of nozzles each capable of forming a dot of a predetermined size to the printing medium. The generation program includes, for process execution by a computer: acquiring image data corresponding to a plurality of pixels of the image; and generating, based on the acquired image data, printing data including information about whether the dot is to be formed for each of the pixels. In the printing data generation program, by referring to a nozzle information storage unit for storage details of information about any of the nozzles whose dot formation details are different from predetermined dot formation details, the generating generates the printing data providing a lower resolution for the image to be printed by at least either the nozzle of different dot formation details or any of the other neighboring nozzles compared with a resolution of the image data acquired by an image data acquisition unit corresponding to the nozzle used for printing.

Such a configuration leads to effects and advantages similar to the printing data generation device of the thirty-second aspect by a computer reading a program and executing processes in accordance with the program.

Forty-second Aspect

A printing data generation program of a forty-second aspect, in the forty-first aspect, with respect to values of the pixels of the image data corresponding to the nozzle of different dot formation details and any of the other neighboring nozzles, the generating selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration leads to effects and advantages similar to the printing data generation device of the thirty-third aspect by a computer reading a program and executing processes in accordance with the program.

Forty-third Aspect

According to a printing data generation program of a forty-third aspect, in the forty-first or forty-second aspect, with respect to values of the pixels of the image data corresponding to the nozzle of different dot formation details and any of the other neighboring nozzles, the generating selects, from a predetermined line position of the image, the nozzle of different dot formation details and any of the neighboring nozzles for exclusion for use with printing the image of the image data.

Such a configuration leads to effects and advantages similar to the printing data generation device of the thirty-forth aspect by a computer reading a program and executing processes in accordance with the program.

Forty-fourth Aspect

According to a printing data generation program of a forty-fourth aspect, in the forty-second aspect, when selecting any of the other neighboring nozzles for exclusion for use, the generating makes the selection from a random position for every line of the image.

Such a configuration leads to effects and advantages similar to the printing data generation device of the thirty-fifth aspect by a computer reading a program and executing processes in accordance with the program.

Forty-fifth Aspect

According to a printing data generation program of a forty-fifth aspect, in any one of the forty-second to forty-fourth aspects, the generating selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration leads to effects and advantages similar to the printing data generation device of the thirty-sixth aspect by a computer reading a program and executing processes in accordance with the program.

Forty-sixth Aspect

According to a printing data generation program of a forty-sixth aspect, in any one of the forty-second to forty-fifth aspects, the generating selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration leads to effects and advantages similar to the printing data generation device of the thirty-seventh aspect by a computer reading a program and executing processes in accordance with the program.

Forty-seventh Aspect

According to a printing data generation program of a forty-seventh aspect, in any one of the forty-first to forty-sixth aspects, the generating generates the printing data in which a portion of the image to be printed with the lower resolution shows a dithering level equivalent to that of the image before the resolution is reduced.

Such a configuration leads to effects and advantages similar to the printing data generation device of the thirty-eighth aspect by a computer reading a program and executing processes in accordance with the program.

Forty-eighth Aspect

According to a printing data generation program of a forty-eighth aspect, in the forty-seventh aspect, the generating generates the printing data in which a dot to be formed by at least either the nozzle of different dot formation details or any of the other neighboring nozzles is larger in size than a dot before the resolution is reduced with respect to the values of the pixels of the image data corresponding to the nozzle.

Such a configuration leads to effects and advantages similar to the printing data generation device of the thirty-ninth aspect by a computer reading a program and executing processes in accordance with the program.

Forty-ninth Aspect

According to a printing data generation program of a forty-ninth aspect, in the forty-seventh or forty-eighth aspect, based on values of the pixels of the image data corresponding to the nozzles for exclusion for use, the generating corrects the values of the pixels of the image data corresponding to any of the nozzles adjacent to the nozzles for exclusion for use, and generates the printing data based on the values of the pixels of the corrected image data.

Such a configuration leads to effects and advantages similar to the printing data generation device of the fortieth aspect by a computer reading a program and executing processes in accordance with the program.

Fiftieth Aspect

A fiftieth aspect of the invention is directed to a computer-readable printing-data-generation-program-recorded recording medium that is recorded with the printing data generation program of any one of the forty-first to forty-ninth aspects.

This leads to effects and advantages similar to the printing data generation program of any one of the forty-first to forty-ninth aspects, and enables easy provision of the printing program via recording media such as CD-ROMs, DVD-ROMs, and FDs (flexible disks).

Fifty-first Aspect

A fifty-first aspect of the invention is directed to a printing data generation method that generates printing data for use in a printing device that prints a predetermined image onto a printing medium using a printing head that includes a plurality of nozzles each capable of forming a dot of a predetermined size to the printing medium. The generation method includes, for execution by a computer device: acquiring image data corresponding to a plurality of pixels of the image; and generating, based on the acquired image data, printing data including information about whether the dot is to be formed or not for each of the pixels. In the printing data generation method, by referring to a nozzle information storage unit for storage details of information about any of the nozzles whose dot formation details are different from ideal dot formation details, the generating generates the printing data providing a lower resolution for the image to be printed by at least either the nozzle of different dot formation details or any of the other neighboring nozzles compared with a resolution of the image data acquired by an image data acquisition unit corresponding to the nozzle used for printing.

Such a configuration leads to effects and advantages similar to the printing data generation device of the thirty-second aspect.

Fifty-second Aspect

According to a printing data generation method of a fifty-second aspect, in the fifty-first aspect, with respect to values of the pixels of the image data corresponding to the nozzle of different dot formation details and any of the other neighboring nozzles, the generating selects, for every line of the image, the nozzle of different dot formation details and any of the other neighboring nozzles for exclusion for use with printing the image of the image data, and generates the printing data based on the values of the pixels of the image data corresponding to the selected nozzles.

Such a configuration leads to effects and advantages similar to the printing data generation device of the thirty-third aspect.

Fifty-third Aspect

According to a printing data generation method of a fifty-third aspect, in the fifty-first or fifty-second aspect, with respect to values of the pixels of the image data corresponding to the nozzle of different dot formation details and any of the other neighboring nozzles, the generating selects, from a predetermined line position of the image, the nozzle of different dot formation details and any of the neighboring nozzles for exclusion for use with printing the image of the image data.

Such a configuration leads to effects and advantages similar to the printing data generation device of the thirty-fourth aspect.

Fifty-fourth Aspect

According to a printing data generation method of a fifty-fourth aspect, in the fifty-second aspect, when selecting any of the other neighboring nozzles for exclusion for use, the generating makes the selection from a random position for every line of the image.

Such a configuration leads to effects and advantages similar to the printing data generation device of the thirty-fifth aspect.

Fifty-fifth Aspect

According to a printing data generation method of a fifty-fifth aspect, in any one of the fifty-second to fifty-fourth aspects, the generating selects, for exclusion for use, the nozzle of different dot formation details and any of the neighboring nozzles to alternately switch, for every predetermined line of the image, between two states of using or not using at least either the nozzle of different dot formation details or the neighboring nozzle.

Such a configuration leads to effects and advantages similar to the printing data generation device of the thirty-sixth aspect.

Fifty-sixth Aspect

According to a printing data generation method of a fifty-sixth aspect, in any one of the fifty-second to fifty-fifth aspects, the generating selects, for exclusion for use, the nozzle of different dot formation details and any of the other neighboring nozzles to establish a positional relationship in which a dot to be formed by the neighboring nozzle comes on the same line as a dot to be formed by the nozzle of different dot formation details with one or more dots disposed therebetween.

Such a configuration leads to effects and advantages similar to the printing data generation device of the thirty-seventh aspect.

Fifty-seventh Aspect

According to a printing data generation method of a fifty-seventh aspect, in any one of the fifty-first to fifty-sixth aspects, the generating generates the printing data in which a portion of the image to be printed with the lower resolution shows a dithering level equivalent to that of the image before the resolution is reduced.

Such a configuration leads to effects and advantages similar to the printing data generation device of the thirty-eighth aspect.

Fifty-eighth Aspect

According to a printing data generation method of a fifty-eighth aspect, in the fifty-seventh aspect, the generating generates the printing data in which a dot to be formed by at least either the nozzle of different dot formation details or any of the other neighboring nozzles is larger in size than a dot before the resolution is reduced with respect to the values of the pixels of the image data corresponding to the nozzle.

Such a configuration leads to effects and advantages similar to the printing data generation device of the thirty-ninth aspect.

Fifty-ninth Aspect

According to a printing data generation method of a fifty-ninth aspect, in the fifty-seventh or fifty-eighth aspect, based on values of the pixels of the image data corresponding to the nozzles for exclusion for use, the generating corrects the values of the pixels of the image data corresponding to any of the nozzles adjacent to the nozzles for exclusion for use, and generates the printing data based on the values of the pixels of the corrected image data.

Such a configuration leads to effects and advantages similar to the printing data generation device of the fortieth aspect.

BRIEF DESCRIPTION OF THE DRAWINGS

The invention will be described with reference to the accompanying drawings, wherein like numbers reference like elements.

FIG. 10 is a diagram showing an exemplary dot size possibly formed by the respective nozzles N.

FIGS. 11A and 11B are diagrams showing an exemplary diffusion direction of an error diffusion process with respect to the image data after data decimation.

DESCRIPTION OF EXEMPLARY EMBODIMENTS

First Embodiment

Described below is a first embodiment of the invention referring to the accompanying drawings.

FIGS. 1 to 12C are all diagrams showing the first embodiment of the invention, i.e., a printing device, a printing device control program and method, and a printing data generation device, program, and method.

Figure 1:
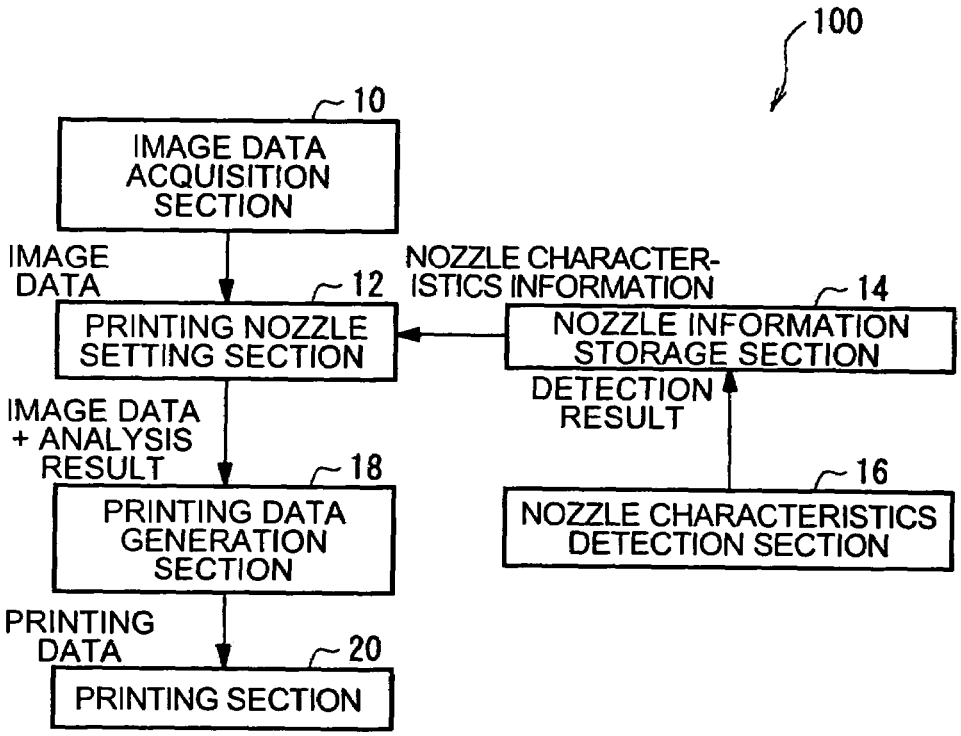
FIG. 1 is a block diagram showing the configuration of a printing device 100 of the invention.

Described first is the configuration of a printing device 100 of the invention by referring to FIG. 1. FIG. 1 is a block diagram showing the configuration of the printing device 100 of the invention.

As shown in FIG. 1, the printing device 100 is configured to include: an image data acquisition section 10; a printing nozzle setting section 12; a nozzle information storage section 14; a nozzle characteristics detection section 16; a printing data generation section 18; and a printing section 20. More specifically, the image data acquisition section 10 acquires image data from any external devices, storage devices, or others. The image data is one configuring any predetermined image. The printing nozzle setting section 12 makes a use details setting for printing nozzles with respect to pixel data of the image data. Such a setting is made based on the characteristics of any specific printing nozzles provided to an internally-provided printing head 200, which will be described later. The nozzle information storage section 14 stores information about the characteristics of the printing nozzles. Such characteristics information is detected by the nozzle characteristics detection section 16 that will be described later, or detected by a measurement test or others before shipment, for example. The nozzle characteristics detection section 16 is capable of detecting, through test printing, the characteristics of the respective printing nozzles provided to the printing head 200. Herein, the characteristics include whether or not the nozzle causes ink deflection, for example. The printing data generation section 18 generates printing data based on the image data, and the setting details made by the printing nozzle setting section 12 for the image data. The printing data is generated in the printing section 20 that will be described later, and images of the resulting image data are to be printed on a printing medium S (printing paper in this example). Based on the printing data, the printing section 20 prints the images of the image data onto the printing paper with ink jet technology.

The image data acquisition section 10 serves to acquire multi-value image data in which tone (brightness value) is represented by 8 bits (0 to 255) on a pixel basis for the respective colors of R, G, and B. The image data acquisition section 10 is capable of acquiring such image data in response to any printing command coming from external devices, input devices of its own printing device 100, or others. Such image data acquisition is made from any external devices over a network such as LAN or WAN, from recording media such as CD-ROMs or DVD-ROMs via drives of its own printing device 100, e.g., CD drives or DVD drives, that are not shown, or from a storage device 70 of its own printing device 100 that will be described later.

The printing nozzle setting section 12 reads nozzle characteristics information about the respective nozzles N provided to the printing head 200. Such information reading is made from the nozzle information storage section 14 in response to any printing command issued against the image data acquired by the image data acquisition section 10. Based on thus read nozzle characteristics information and the image data corresponding to the printing command, the printing nozzle setting section 12 refers to the dot formation details of the nozzles to determine whether there is any nozzle not at its ideal position (specifically, any nozzle causing ink deflection) for image printing correctly on the printing paper. If such a nozzle is found, the printing nozzle setting section 12 makes a setting of whether or not to use at least either thus found nozzle or any of the neighboring nozzles for image data printing. This setting is made for every pixel data of the image data. Based on the setting details, the printing nozzle setting section 12 subjects the image data both to a pixel data decimation process corresponding to the region at which no nozzle is used, and a density value distribution process. The density value distribution process is executed to prevent the dithering level from lowering in the image part by the pixel data decimation process.

Figure 3:
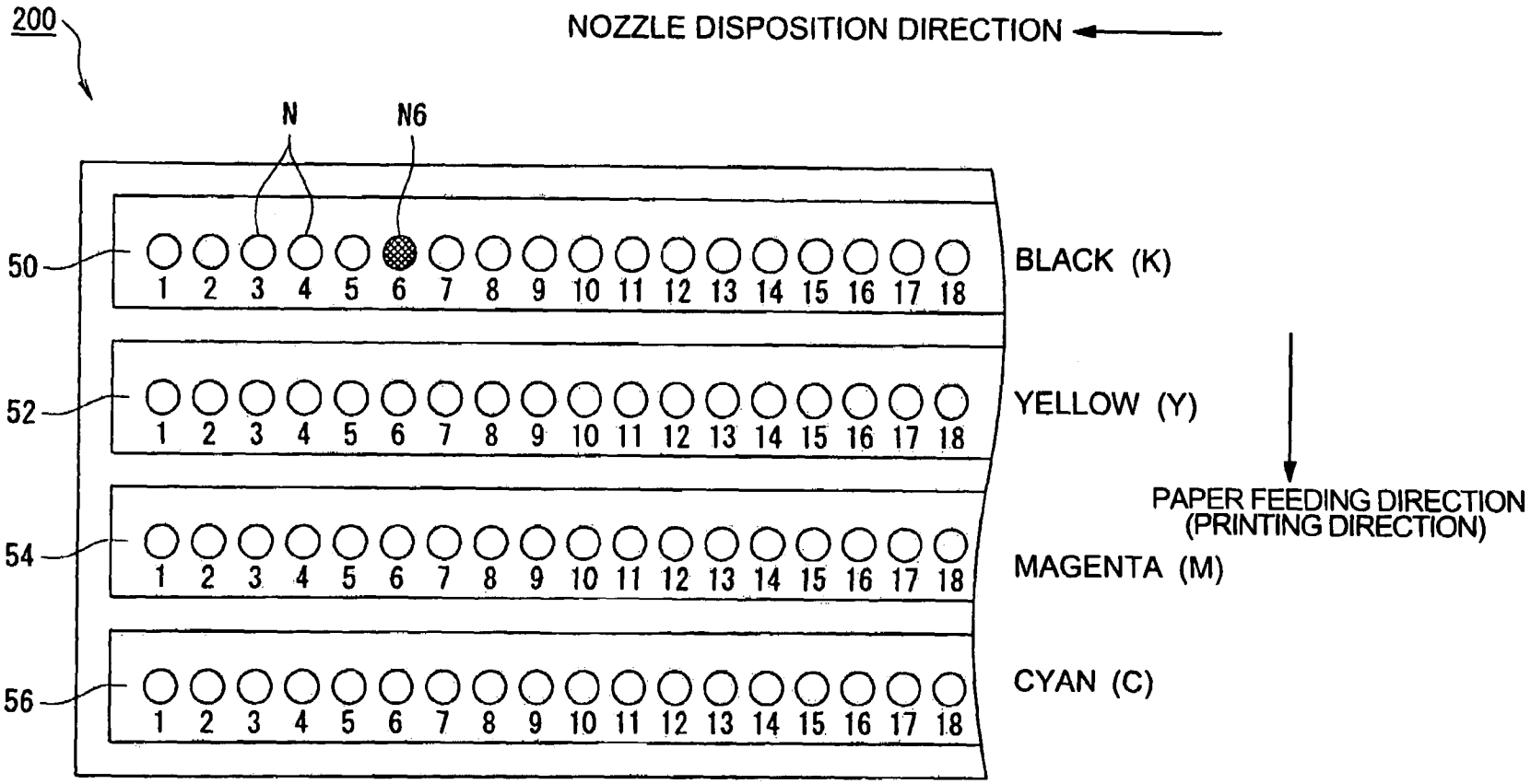
FIG. 3 is a partially-enlarged bottom view of a printing head 200 of the invention.
Figure 4:
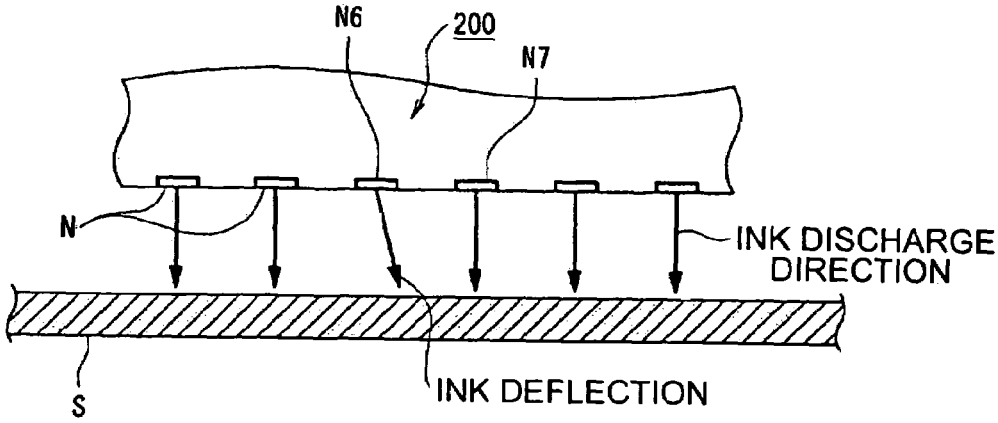
FIG. 4 is a partially-enlarged side view of the printing head 200 of FIG. 3.

The nozzle information storage section 14 serves to store the characteristics of nozzles provided to the printing head 200, which is used in the ink-jet-type printing section 20 that will be described later. Here, the characteristics of nozzles are information used for determining whether any of the nozzles N provided to the printing head 200 used in the printing section 20 of FIGS. 3 and 4 is (are) causing ink deflection. If determined Yes, the nozzle information storage section 14 uses the information for specifically identifying which of the nozzles N is (are) faulty, i.e., causing ink deflection.

FIG. 3 is a partially-enlarged bottom view of the printing head 200 of the invention, and FIG. 4 is a partially-enlarged side view thereof.

As shown in FIG. 3, the printing head 200 is configured to include four nozzle modules of: a black nozzle module 50; a yellow nozzle module 52; a magenta nozzle module 54; a cyan nozzle module 56. More specifically, the black nozzle module 50 carries a plurality of nozzles N (18 in the drawing) in a line, each of which discharges only black (K) ink. The yellow nozzle module 52 carries a plurality of nozzles N in a line, each of which discharges only yellow (Y) ink. The magenta nozzle module 54 carries a plurality of nozzles N in a line, each of which discharges only magenta (M) ink. The cyan nozzle module 56 carries a plurality of nozzles N in a line, each of which discharges only cyan (C) ink. As shown in FIG. 3, the nozzle modules 50, 52, 54, and 56 are disposed as a unit in such a configuration that the nozzles N sharing the same number among these four nozzle modules come on the same line in the paper feeding direction, i.e., direction perpendicular to the direction along which the nozzles are disposed in the printing head 200. Accordingly, the nozzles N configuring the respective nozzle modules are disposed in a line along the nozzle disposition direction of the printing head 200. The nozzles N sharing the same number among these four nozzle modules are disposed in line in the paper feeding direction.

As to these four nozzle modules 50, 52, 54, and 56, FIG. 4 shows an exemplary case where the nozzle N6 in the black nozzle module 50 located 6th from the left is causing ink deflection, and the nozzle N6 discharges ink onto the printing medium S in the diagonal direction. In such a case, dots formed by the faulty nozzle N6 on the printing medium S are formed in the vicinity of dots formed by a normal nozzle N7 on the printing medium S. The nozzle N7 is the one located next to the nozzle N6.

Referring back to FIG. 1, the nozzle characteristics detection section 16 checks the characteristics of the printing head 200, and stores the check result together with the data of the nozzle information storage section 14 or writes the check result over the data. Such a check operation is executed against the printing result derived by the printing head 200, utilizing a unit for reading optical printing results on a regular basis or at any predetermined time to be ready for a case if the printing head 200 is changed in characteristics after use of the printing device 100. Here, it is understood that the characteristics of the printing head 200 are fixed during manufacturing to some extent, and once manufactured, the characteristics hardly change except when discharge failures such as ink clogging occur, for example. Therefore, in most cases, there is no need to provide the nozzle characteristics detection section to the respective printing devices if the nozzle characteristics are checked at shipment, and stored in the nozzle information storage section 14 in advance.

Although a detailed description will be given later, the printing data generation section 18 serves to convert the image data provided by the printing nozzle setting section 12 into printing data for use in the printing section 20 of an ink jet type, which will be described later, i.e., into data about whether dots of a predetermined color and size are to be formed for every pixel data of the image data. Such data conversion is hereinafter referred to as "binarization" or "half toning" as appropriate. At the time of such data conversion, with consideration of whether the faulty nozzle and its neighboring nozzle(s) are forming dots or not for each pixel data, the printing data generation section 18 determines not to use a part of the nozzles, or exercises control over the size of dots to be formed by the nozzle(s) and their neighboring nozzles. The nozzle(s) determined not to be used are those corresponding to the image part in which a banding problem is observed due to ink deflection caused by the faulty nozzle. In such a manner, the image data can be converted into printing data of a low resolution.

The printing section 20 is an ink jet printer with which a predetermined image is formed on the printing medium (paper) S. The image is configured by a plurality of dots of ink ejected from the nozzle modules 50, 52, 54, and 56 provided to the printing head 200. Such dots are formed while either the printing medium S or the printing head 200 or both are moved. Together with the printing head 200, the printing section 20 is configured to include: a printing head feeding mechanism (with a multi-path printer); a feeding mechanism; and a printing control mechanism, all of which are not shown. Specifically, the printing head feeding mechanism reciprocates the printing head 200 in the width direction of the printing medium (paper) S, and the feeding mechanism moves the printing medium (paper) S. The printing control mechanism exercises control over the ink discharge from the printing head 200 based on the binary data.

Figure 2:
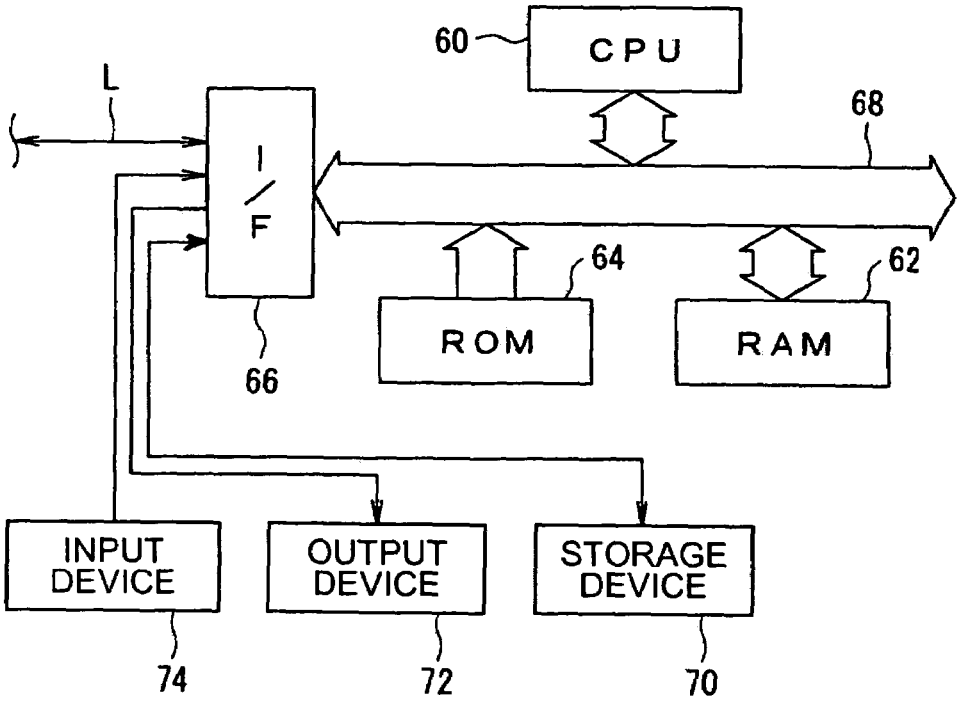
FIG. 2 is a diagram showing the hardware configuration of a computer system.

The printing device 100 is provided with a computer system for the purpose of implementing the component functions of the image data acquisition section 10, the printing nozzle setting section 12, the nozzle characteristics detection section 16, the printing data generation section 18, the printing section 20, and others, and executing software of hardware control required for such component functions' implementation. As shown in FIG. 2, the computer system has such a-hardware configuration that an In/Out bus 68 connects together a CPU (Central Processing Unit) 60, RAM (Random Access Memory) 62, and ROM (Read Only Memory) 64. The In/Out bus 68 varies in type, including PCI (Peripheral Component Interconnect) bus, ISA (Industrial Standard Architecture), or others. Herein, the CPU 60 takes charge of various control applications and computation. The RAM 62 serves as a main storage, and the ROM 64 is provided specifically for data reading. In the hardware configuration, the In/Out bus 68 is connected with, through an Input/Output interface (I/F) 66, the storage device 70 (secondary storage) such as HDD, an output device 72, an input device 74, a network cable L for communications with a printing command device that is not shown, and others. Herein, the output device 72 is exemplified by the printing section 20, CRT, LCD monitor, or others, and the input device 74 by an operation panel, mouse, keyboard, scanner, or others.

When the printing device 100 is turned ON, the component functions as described above are implemented on the software by the CPU 60 applying predetermined control and performing computation by putting various resources to full use. For such control application and computation, the CPU 60 follows commands written in programs loaded to the RAM 62. The programs are those loaded by a system program such as BIOS stored in the ROM 64 or others, including various specific computer programs previously stored in the ROM 64 or installed in the storage device 70 via recording media including CD-ROMs, DVD-ROM flexible disks (FDs), or others, or via a communications network such as the Internet.

Figure 5:
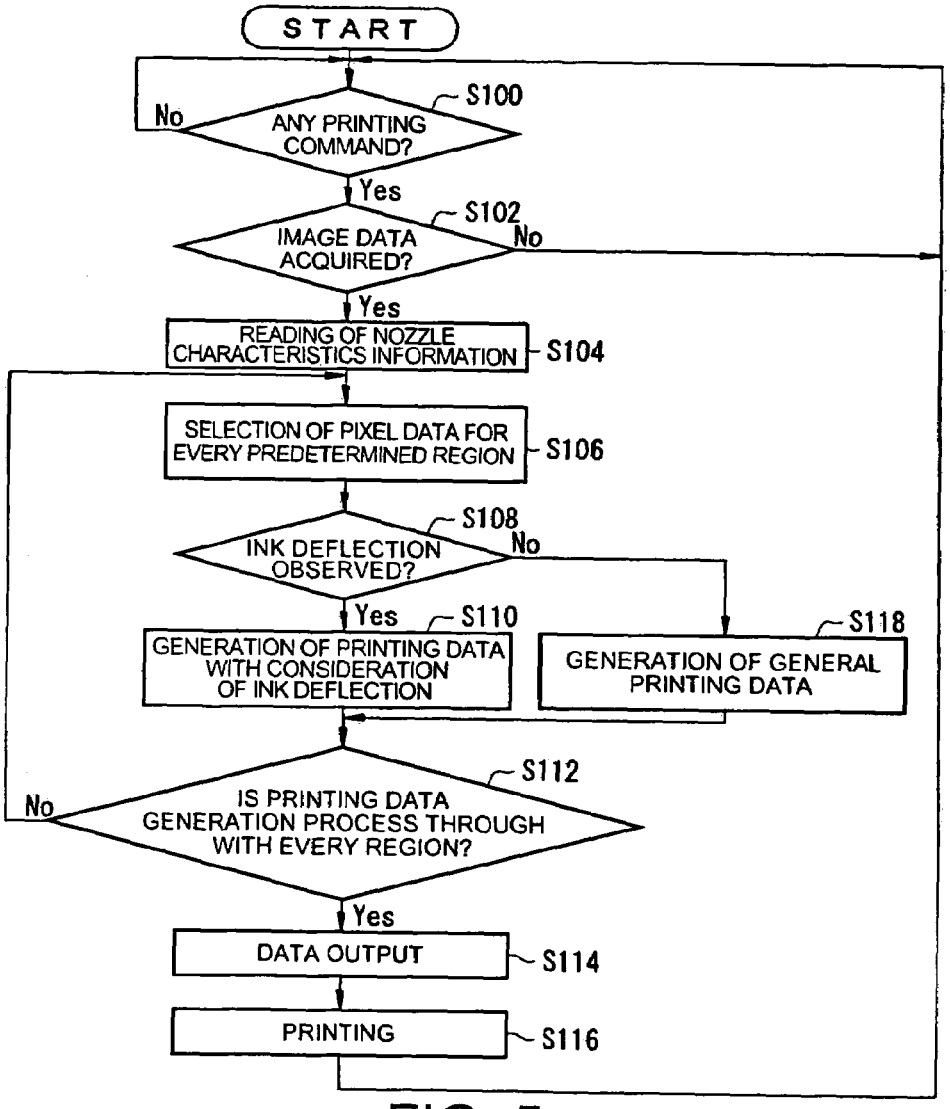
FIG. 5 is a flowchart of a printing process in the printing device 100.

The printing device 100 has the CPU 60 activated a predetermined program stored in any given region of the ROM 64, and in accordance with the program, executes the printing process in the flowchart of FIG. 5. As described above, the printing head 200 for dot formation is generally so configured as to form dots of various colors, e.g., four or six, substantially at the same time. For the sake of simplification, described below is an exemplary case in which every dot is presumably formed by the printing head 200 using a single color (monochrome color), and the resulting image is a monochrome image.

FIG. 5 is a flowchart of the printing process in the printing device 100.

As shown in FIG. 5, when executed by the CPU 60, the printing process is started from step S100.

In step S100, the image data acquisition section 10 determines whether a printing command is provided. Such a determination is made in response to printing command information coming from any external device connected through the network cable L, or printing command information coming via the input device 74. When the determination is Yes, the procedure goes to step S102, and when No, the determination process is repeated until a printing command comes.

In step S102, the image data acquisition section 10 goes through a process of acquiring image data corresponding to the printing command from recording media, the storage device 70, or others. The recording media include, as described above, external devices, CD-ROMs, DVD-ROMs, or others, and the storage device 70 includes HDDs or others. When the image data is determined as being acquired (Yes), the acquired image data is forwarded to the printing nozzle setting section 12, and the procedure goes to step S104. When the determination is No, the image data acquisition section 10 makes a notification to tell the source of printing command that the printing cannot be performed, for example, and terminates the printing process for the printing command. The procedure then returns to step S100. The image data here is the one configured by a plurality of multi-value pixel data disposed in matrix. The line direction of the image data is the same as the nozzle disposition direction in the printing head 200, and the column direction thereof is the same as the movement direction (paper feeding direction) of the printing head 200.

In step S104, the printing nozzle setting section 12 reads nozzle characteristics information from the nozzle information storage section 14. The procedure then goes to step S106.

In step S106, the printing nozzle setting section 12 makes a selection of pixel data of a predetermined region from the image data acquired in step S102. The procedure then goes to step S108. The predetermined region here is a data region including a pixel data column in the image data corresponding to a faulty nozzle, and a predetermined number of neighboring pixel data columns, e.g., pixels of eight columns in the vicinity of the line corresponding to the faulty nozzle (four columns on the right and 4 columns on the left).

In step S108, the printing nozzle setting section 12 determines whether the pixel data of the predetermined region corresponds to the faulty nozzle of the printing head 200 causing ink deflection. Such a determination is made based on the nozzle characteristics information read in step S104, and the pixel data of the predetermined region selected in step S106. When the determination is Yes, the procedure goes to step S110, and when No, the procedure goes to step S118.

When the procedure goes to step S110, it means that there is the pixel data corresponding to the faulty nozzle causing ink deflection. Accordingly, in the printing nozzle setting section 12 and the printing data generation section 18, printing data is generated with consideration given to ink deflection for the pixel data of the predetermined region. The procedure then goes to step S112.

In step S112, the printing data generation section 18 determines whether the printing data is generated for the entire pixel data of the image data. When the determination is Yes, the procedure goes to step S114, and when No, the procedure goes to step S106.

In step S114, the printing data generation section 18 forwards the printing data generated in step S108 toward the printing section 20. The procedure then goes to step S116.

In step S116, the printing section 20 goes through the printing process based on the printing data provided by the printing data generation section 18. The procedure then returns to step S100.

In step S108, when the procedure goes to step S118 with no faulty nozzle in the printing head 200 causing ink deflection, the printing data is generated by subjecting the predetermined region of the image data to normal data conversion (binarization) together with an error diffusion process that will be described later, for example. The procedure then goes to step S112.

By referring to FIG. 6, described next in detail is a printing data generation process with consideration given to ink deflection in step S110.

Figure 6:
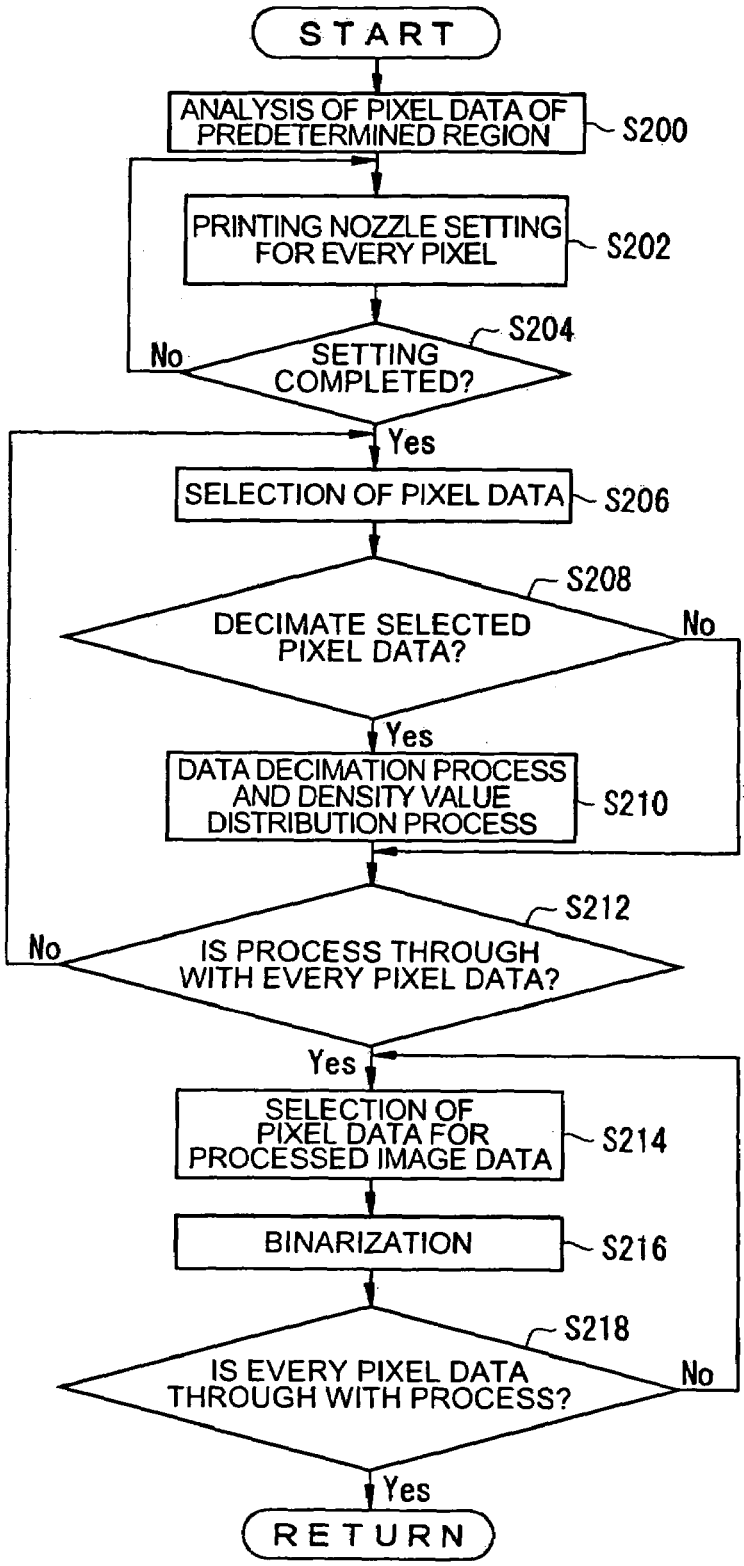
FIG. 6 is a flowchart of a printing data generation process in the printing device 100 with consideration given to ink deflection.

FIG. 6 is a flowchart of the printing data generation process with consideration given to ink deflection in the printing device 100.

In the printing data generation process, a nozzle use setting is made whether a nozzle is used for the pixel data of the predetermined region in the image data. The nozzle here is at least either the faulty nozzle causing ink deflection or any of its neighboring nozzles. The setting result is then used as a basis to subject the pixel data of the predetermined region to a data decimation process and a density value distribution process. The printing data is then generated based on the image data having been subjected to such processes. After such a printing data generation process is started in step S110, as shown in FIG. 6, the procedure first goes to step S200.

In step S200, the printing nozzle setting section 12 analyzes the image data of the predetermined region to see the correspondence between the pixel data of the predetermined region and the respective nozzles N provided to the printing head 200. The procedure then goes to step S202. In this analysis process, analysis subjects are the image size, printing command information about specified paper size, printing mode, or others, and the correspondence between the pixel data and the respective nozzles N is derived. This is surely not restrictive, and the analysis process may be skipped if the ROM 64 previously stores information about the correspondence of image data size or the printing mode, for example.

In step S202, the printing nozzle setting section 12 makes a setting of whether the pixel data of the predetermined region is used with the corresponding nozzle N. Such a setting is made based on the analysis result of step S200, and the nozzle characteristics information read from the nozzle information storage section 14. The procedure then goes to step S204.

In the present embodiment, presumably, a setting is so made that the faulty nozzle causing ink deflection is not to be used for every corresponding pixel data. Another setting is also made that a nozzle not on the immediate right of the faulty nozzle but with a nozzle disposed therebetween, and a nozzle not on the immediate left of the faulty nozzle with a nozzle disposed therebetween are not to be used for the corresponding pixel data. To be more specific, by referring to FIG. 3, assuming that the nozzle N6 is faulty causing ink deflection, a setting is made that the nozzle N4 with the nozzle N5 disposed therebetween, and the nozzle N8 with the nozzle N7 disposed therebetween are not to be used for the corresponding pixel data.

In step S204, the printing nozzle setting section 12 determines whether a nozzle N use setting is completely made. When the determination is Yes, the procedure goes to step S206, and when No, the procedure returns to step S202 to continue the setting process.

In step S206, the printing nozzle setting section 12 selects any predetermined pixel data from the predetermined region of the image data. The procedure then goes to step S208.

In step S208, the printing nozzle setting section 12 determines whether the selected pixel data corresponds to the not-to-be-used nozzle, i.e., whether the selected pixel data is to be decimated. Such a determination is made based on the pixel data selected in step S206, and the setting information in step S202. When the determination is Yes, the procedure goes to step S210, and when No, the procedure goes to step S212.

In step S210, the printing nozzle setting section 12 goes through a process of decimating the pixel data selected in step S206, i.e., a process of forming no dot. The printing nozzle setting section 12 also goes through a process of distributing the density value of the to-be-decimated pixel data to the pixel data on both sides thereof. The procedure then goes to step S212. In the present embodiment, for example, the density value of the to-be-decimated pixel data is divided into two, and the resulting values are each added to the density value of the pixel data on both sides.

In step S212, the printing nozzle setting section 12 determines whether every pixel data is selected, and whether the process is completed. When the determination is Yes, the image data through with data decimation and density value distribution is forwarded to the printing data generation section 18, and then the procedure goes to step S214. When the determination is No, the procedure returns to step S206.

In step S214, the printing data generation section 18 selects the predetermined pixel data from the image data through with data decimation and density value distribution. The procedure then goes to step S216.

In step S216, the printing data generation section 18 applies binarization to the pixel data selected in step S214, and the procedure goes to step S218. Here, binarization is a process of converting multi-value data into either of two values based on a threshold value. Such data conversion is made through comparison between multi-value data found in a specific value range, and a predetermined threshold value, e.g., median value in a specific value range. Assuming that there is multi-value in a value range of 0 to 255, a threshold value is set to "127" being a median value. When the value of the multi-value data is larger than "127", the multi-value data is converted to "255", and when the value is equal to or smaller than the threshold value, the multi-value data is converted to "0". Because the present embodiment generates printing data, the determination factor will be whether a printing medium is formed with dots or not. For example, the value of "1" is assigned for dot formation, and the value of "0" is assigned for no dot formation. In the present embodiment, in addition to such two values of dot formation or no dot formation, a plurality of sizes are set for dots to be formed by the nozzles depending on the density value of the pixel data. A threshold value is set from the value range of the density values for each of the dot sizes, and the threshold value is compared with the pixel data (multi-value data). Based on the comparison result, the pixel data is converted into the value for dot formation or that for no dot formation. In an exemplary case with N dot sizes ($N \geqq 2$), the dot sizes are assigned with each different value representing "dot formation" so that the pixel data takes N values. In such a case, a value representing "no dot formation" is always "0".

In the present embodiment, binarization is performed for every dot size with a value of "1" for dot formation, and a value of "0" for no dot formation. Among the dot sizes determined as "formed", the largest size is selected, and information about the largest size is added to the value of "1".

The present embodiment is adopting the technique of error diffusion for such binarization, thereby enabling tone representation by dithering.

The error diffusion is a well-known technique, and when multi-value data is subjected to binarization with a specific threshold value, any difference from the threshold value is not neglected but diffused as an error for pixels to be processed. Assuming that a processing-target pixel is of 8 bits (256 tones) with a tone of "101", the tone is smaller than "127" being the threshold value (median value). In the normal binarization, the pixel is thus processed as a pixel of "0" formed with no dot, and the tone "101" is neglected. On the other hand, in the error diffusion, the tone "101" is diffused among its around not-yet-processed pixels in accordance with any predetermined error diffusion matrix. By taking a pixel right of the target pixel as an example, in the normal binarization, it is to be processed as "no dot formation" as is not satisfying the threshold value similarly to the target pixel. With the error diffusion from the target pixel, the density value of the pixel exceeds the threshold value, and thus can be processed as "dot formation". As such, the resulting binary data can be much closer to the original image data.

In step S218, the printing data generation section 18 determines whether every pixel data of the predetermined region is through with binarization and error diffusion. When the determination is Yes, this is the end of the processes, and the procedure returns.

Herein, the printing data in the present embodiment is about whether the pixels are each formed with a dot of a predetermined color and size. As such, not every pixel is formed with a dot. In the present embodiment, data decimation is performed with respect to the pixel data corresponding to any faulty nozzle causing ink deflection, and the pixel data corresponding to any of the neighboring nozzles, e.g., two nozzles on both sides of the faulty nozzle, not immediately but with a nozzle each disposed therebetween. The density value of the decimated pixel data is distributed to the pixel data on both sides so that the image part composed of ink-deflected column pixels and any neighboring pixels is reduced in resolution, and the dithering level is prevented from lowering as a result of such resolution reduction.

Described next is the operation of the present embodiment by referring to FIGS. 7 to 12C.

Figure 7:
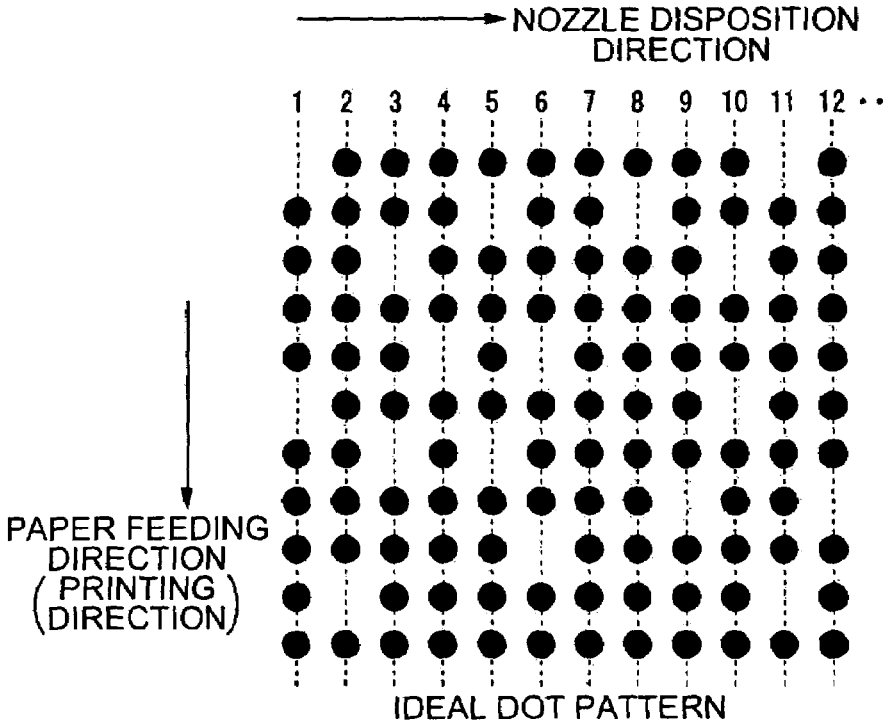
FIG. 7 is a diagram showing an exemplary dot pattern to be formed only by a black nozzle module 50, which includes no faulty nozzle as a cause of ink deflection.
Figure 8:
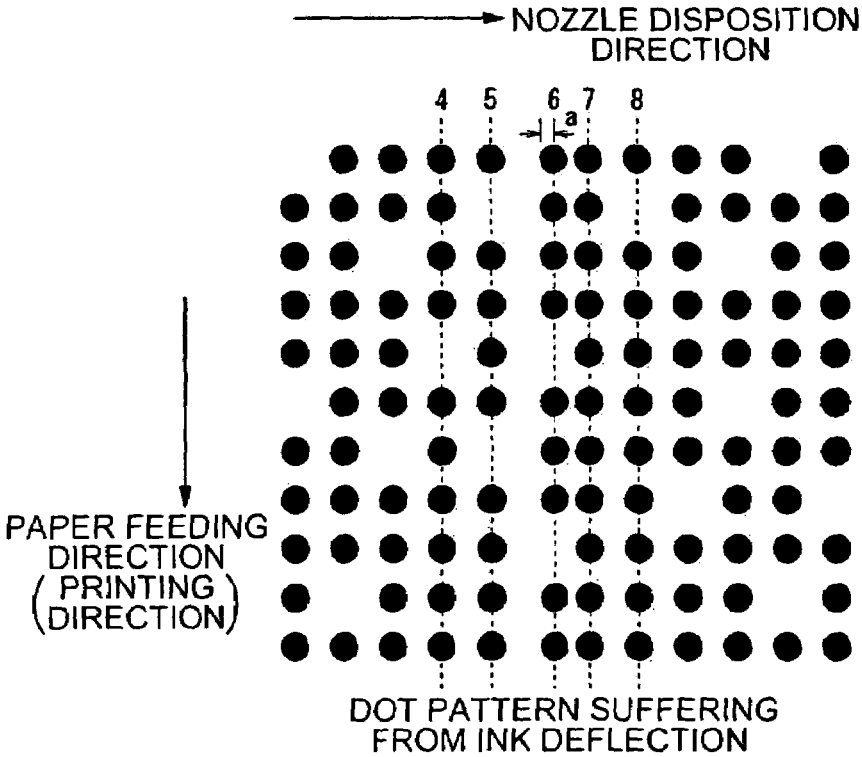
FIG. 8 is a diagram showing an exemplary dot pattern to be formed by the black nozzle module 50 in which a nozzle N6 is assumed as being a cause of ink deflection.
Figure 9A:
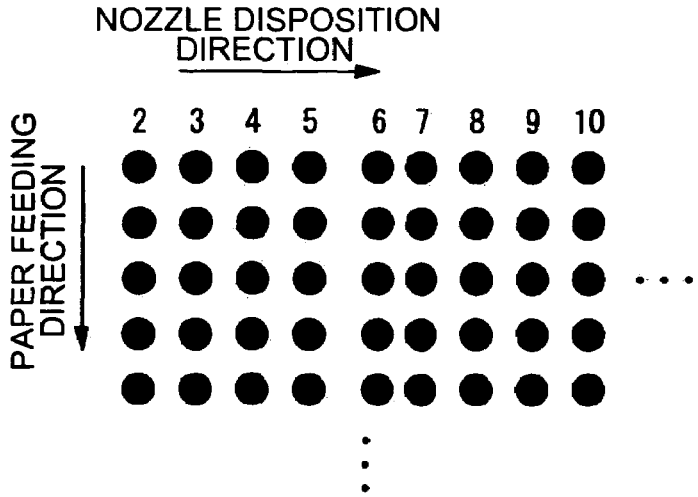
FIG. 9A is a diagram partially showing a dot pattern to be formed in the case of FIG. 8.
Figure 9B:
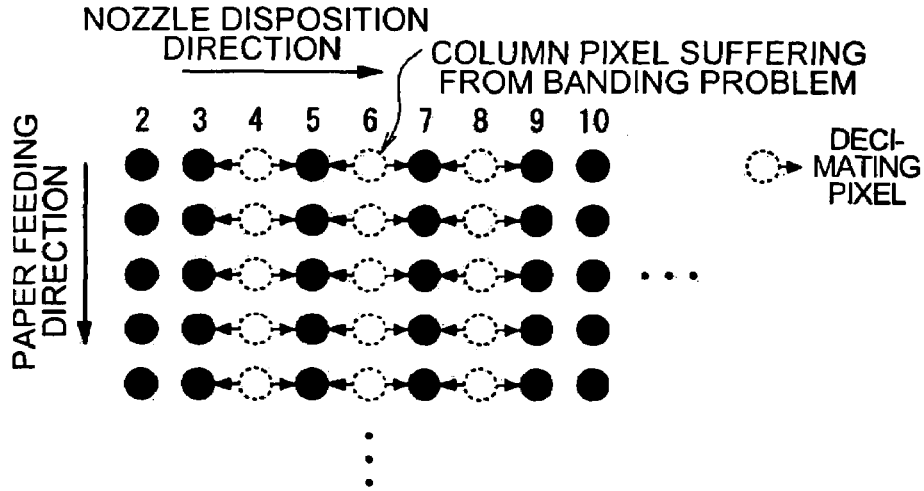
FIG. 9B is a diagram showing decimation of column pixel data respectively corresponding to nozzles N4, N6, and N8 from the dot pattern of FIG. 9A.
Figure 9C:
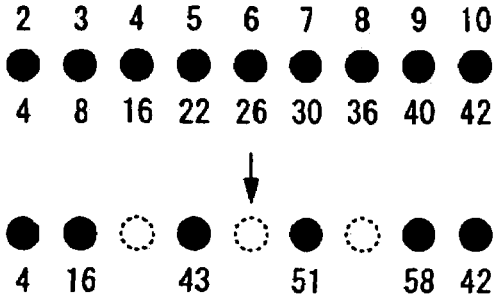
FIG. 9C is a diagram showing exemplary density value distribution to pixel data found on both sides of image data to be decimated.
Figure 12A:
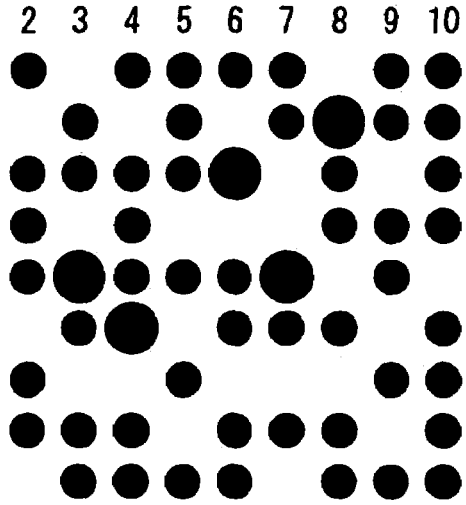
FIG. 12A is a diagram showing an exemplary dot pattern of a filled-in image that is formed by a printing head being free from ink deflection.
Figure 12B:
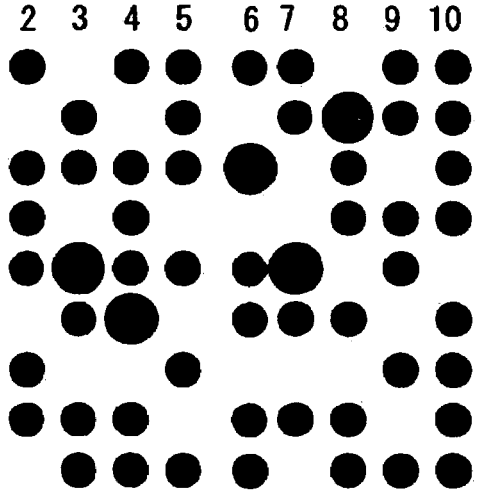
FIG. 12B is a diagram showing an exemplary dot pattern of a filled-in image that is formed by a printing head in which the nozzle N6 is observed with ink deflection.
Figure 12C:
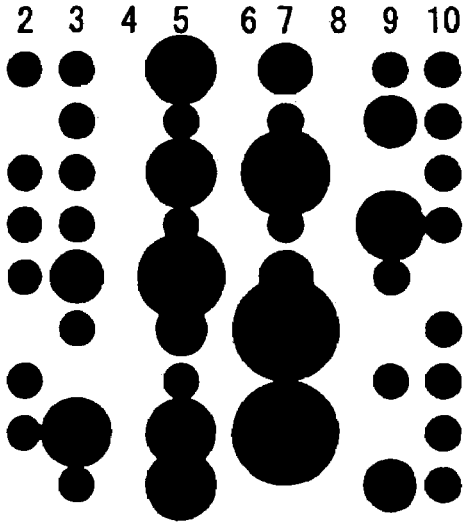
FIG. 12C is a diagram showing an exemplary dot pattern that is formed based on printing data with consideration given to ink deflection of the nozzle N6.

FIG. 7 is a diagram showing an exemplary dot pattern to be formed only by the black nozzle module 50, which includes no faulty nozzle as a cause of ink deflection. FIG. 8 is a diagram showing an exemplary dot pattern to be formed by the black nozzle module 50 in which the nozzle N6 is assumed as being a cause of ink deflection. FIG. 9A is a diagram partially showing a dot pattern to be formed in the case of FIG. 8, FIG. 9B is a diagram showing decimation of column pixel data respectively corresponding to nozzles N4, N6, and N8 from the dot pattern of FIG. 9A, and FIG. 9C is a diagram showing exemplary density value distribution to pixel data found on both sides of pixel data to be decimated. FIG. 10 is a diagram showing an exemplary dot size possibly formed by the respective nozzles N. FIGS. 11A and 11B are diagrams showing an exemplary diffusion direction of an error diffusion process with respect to the image data after pixel data decimation. FIG. 12A is a diagram showing an exemplary dot pattern of a filled-in image that is formed by a printing head being free from ink deflection, FIG. 12B is a diagram showing an exemplary dot pattern of a filled-in image that is formed by a printing head in which the nozzle N6 is observed with ink deflection, and FIG. 12C is a diagram showing an exemplary dot pattern that is formed based on printing data with consideration given to ink deflection of the nozzle N6.

As shown in FIG. 7, a dot pattern formed by the black nozzle module 50 including no faulty nozzle causing ink deflection is free from a banding problem as "white streaks" or "dark streaks" as described above. The banding problem results from any displacement of nozzle interval.

On the other hand, FIG. 8 shows the printing result by the black nozzle module 50 in which the nozzle N6 is faulty. In the dot pattern, the dots formed by the nozzle N6 are displaced by a distance a toward the dots formed by the correct nozzle N7 on the right side. As a result, a white streak is observed between the dots formed by the nozzle N6 and the dots formed by the nozzle N5 on the left side.

The "white streaks" look relatively conspicuous when the printed image is solidly filled (including entire or part of a printed image of uniform density), and when color difference is considerably large, e.g., printing paper of white and ink of black. As a result, the quality of the printing result is considerably degraded.

When any other nozzle module is used as an alternative to the black nozzle module 50, due to the displacement of the nozzle N6 by the distance a as a result of ink deflection, the displacement of the distance a between the nozzle N6 and the nozzle N7 on the right side increases the dot density so that the part looks conspicuous as a "dark streak". In this case, the quality of the printing result is also conspicuously degraded.

As such, the printing device 100 of the invention decimates, from the image data for printing, not only the pixel data corresponding to a faulty nozzle causing ink deflection, i.e., nozzle N6, but also the pixel data corresponding to any of the neighboring nozzles so that the image part observed with ink deflection is reduced in resolution. In this manner, "white streaks" or "dark streaks" are made less noticeable. Moreover, the printing device 100 distributes the density value of the to-be-decimated pixel data among the pixel data on both sides so that the dithering level is prevented from lowering in the image part. Accordingly, the image resolution can be reduced while substantially keeping the dithering level.

When the image data acquisition section 10 receives printing command information from any external device (step S100), the printing device 100 acquires image data corresponding to the printing command information from the external device or others being the source of the information. The acquired image data is forwarded to the printing nozzle setting section 12 (step S102). The printing nozzle setting section 12 reads nozzle characteristics information from the nozzle information storage section 14 (step S104), and selects the pixel data of the predetermined region from the acquired image data (step S106). Referring to the selected pixel data of the predetermined region and the read nozzle characteristics information, in the black nozzle module 50 of the printing head 200, the printing nozzle setting section 12 determines whether the pixel data of the predetermined region corresponds to any faulty nozzle causing ink deflection (step S108). If the data corresponds to the faulty nozzle, the procedure moves to the printing data generation process with ink deflection considered (step S110).

In the printing data generation process with ink deflection considered, first of all, the printing nozzle setting section 12 goes through a process of decimating, from the pixel data of the predetermined region, the pixel data corresponding to the faulty nozzle causing ink deflection, and the pixel data corresponding to any of the neighboring nozzles. This data decimation is performed based on the pixel data of the predetermined region, and the nozzle characteristics information. In this example, similarly to the above, a case is assumed where the nozzle N6 in the black nozzle module 50 is causing ink deflection, and the printing result derived by the black nozzle module 50 looks as shown in FIG. 9A, i.e., the dots formed by the nozzle N6 are displaced by the distance a toward the dots formed by the nozzle N7. The distance between the nozzles N5 and N6 looks thus wider than usual, and the distance between the nozzles N6 and N7 looks narrower than usual. The printing nozzle setting section 12 thus analyzes the pixel data of the predetermined region based on the nozzle characteristics information (step S200). As shown in FIG. 9B, the printing nozzle setting section 12 also makes a nozzle disuse setting against the pixel data corresponding to the nozzles N4 and N8, which are located on both sides of the faulty nozzle N6, not immediately but with the nozzles N5 and N7 respectively disposed therebetween (step S202). That is, the nozzles of N4, N6, and N8 are not used for their corresponding pixel data. Based on such a nozzle disuse setting, the printing nozzle setting section 12 decimates the pixel data corresponding to such not-to-be-used nozzles from the acquired image data. At this time, the printing nozzle setting section 12 also executes a process of distributing the density value of the to-be-decimated pixel data among the pixel data on both sides thereof (steps S208 and S210).

In the distribution process, for example, the density value of the pixel data corresponding to the not-to-be-used nozzle is divided into two (or may be three or more), and the resulting values are each added to the density value of the pixel data corresponding to the nozzles on both sides of the not-to-be-used nozzle. Assuming that the density value of the pixel data corresponding to the not-to-be-used nozzle N6 is indicating "26", the value of "13" being the half of "26" is added to the density value of the pixel data corresponding to the nozzles N5 and N7 located on both sides of the nozzle N6. Hereinafter, the value as a result of division is referred to as distribution value. Similarly, the value of "8" being the half of the density value "16" of the pixel data corresponding to the nozzle N4 is added to the density value of the pixel data corresponding to the nozzles N3 and N5 located on both sides of the nozzle N4. The value of "18" being the half of the density value "36" of the pixel data corresponding to the nozzle N8 is also added to the density value of the pixel data corresponding to the nozzles N7 and N9 located on both sides of the nozzle N8. As shown in FIG. 9C, after such density value distribution, the density value corresponding to the nozzle N3 will be "16", the initial value of "8" plus the distribution value of "8" from the nozzle N4. The density value corresponding to the nozzle N5 will be "43", the initial value of "22" plus the distribution values of "8" and "13" from the nozzles N4 and N6, respectively. The density value corresponding to the nozzle N7 will be "51", the initial value of "30" plus the distribution values of "13" and "18" from the nozzles N6 and N8, respectively. The density value corresponding to the nozzle N9 will be "58", the initial value of "40" plus the distribution value of "18" from the nozzle N8. That is, by the data decimation process and the density value distribution process, the pixel data corresponding to the nozzles N4, N6, and N8 is decimated from the acquired image data, and as described above, the density values of the decimated pixel data are distributed to the pixel data on both sides.

After the data decimation process and the density value distribution process, the image data is forwarded to the printing data generation section 18 for binarization therein (step S216).

As described in the foregoing, the binarization is a process of comparing the density value of the pixel data with a threshold value that is each set to various sizes of nozzle-formable dots. Based on the comparison result, the value of "1" is assigned for forming dots of the sized and the value of "0" is assigned for not forming dots of the size.

In the present embodiment, as shown in FIG. 10, there are four dot sizes of "super large", "large", "medium", and "small". When the pixel data indicates the density value in a range of "0 to 24, exclusive", it is determined as "no dot formation" and thus no dot is formed. When the pixel data indicates the density value in a range of "24 to 126, inclusive", dots of the size "small" corresponding to the density value of "84" are formed. When the pixel data indicates the density value in a range of "126 to 212, inclusive", dots of the size "medium" corresponding to the density value of "168" are formed. When the pixel data indicates the density value in a range of "212 to 298, inclusive", dots of the size "large" corresponding to the density value of "255" are formed. When the pixel data indicates the density value larger than 298, dots of the size "super large" corresponding to the density value of "340" are formed.

The binarization is performed with the technique of error diffusion, for example. In the error diffusion, assuming that processing-target pixel data indicates the density value of a, dots of the size "small" are formed if with "$\alpha \leqq 84$", i.e., the value of "1". If with "$85<\alpha$", no dot is formed, i.e., the value of "0". Similarly, for the medium-sized dots, the value will be "1" if with "$86 \leqq \alpha \leqq 168$", and the value will be "0" if with "$\alpha<85$", and "$168<\alpha$". For the large-sized dots, the value will be "1" if with "$169 \leqq \alpha \leqq 255$", and the value will be "0" if with "$\alpha \leqq 168$". For the super-large-sized dots, the value will be "1" if with "$255<\alpha$", and the value will be "0" if with "$\alpha \leqq 255$". That is, based on such comparison results, if some of the four dot sizes indicate the value of "1" indicating dot formation, the largest dot size is selected therefrom. If none of the four dot sizes indicates the value of "0" indicating no dot formation, the value of "0" is selected.

For the error diffusion, such an error diffusion matrix as shown in FIG. 11B can be used. With any text-devoted process, the error diffusion is not the only option, and values may be determined simply by comparing threshold values of pixels. Alternatively, the technique of dithering or others may be adopted for representation of dithering levels.

As such, every pixel data of the predetermined region having been subjected to data decimation and density value distribution is converted into either the value of "1" or "0", indicating forming dots of any one size of the above four, or forming no dot. For example, a value indicating dot formation of the "super large" size is "LL1", which is the value of "1" indicating dot formation plus information about size. Similarly, the value of the "large" size is "L1", the value of the "medium" size is "M1", and the value of the "small" size is "S1". In this case, the pixel data is converted into either any one of these values or "0" indicating no dot formation.

The technical method for controlling dot size as such includes a technique of providing piezo actuator to a printing head. Such a technique is easily implemented by controlling the ink discharge amount through voltage change for application to the piezo actuator.

After such data decimation and density value distribution, when every pixel data of the predetermined region of the image data is through with binarization (step S218), and when the pixel data of every region of the image data is through therewith (step S112), the image data having been subjected to binarization is forwarded to the printing section 20 as the printing data (step S114).

Based on the printing data thus provided by the printing data generation section 18, the printing section 20 uses the black nozzle module 50 to perform dot formation (printing) on a printing medium (step S116). As shown in FIG. 12C, in the formation result, no dot is formed for the adjacent nozzles N4, N6, and N8, and the dots at the positions corresponding to the nozzles N3, N5, N7, and N9 are bigger than the formation result of FIG. 12B. That is, the formation result of FIG. 12B is derived for the case where the printing data is generated in a normal manner with no consideration for the fact that nozzle N6 is causing ink deflection, i.e., neither data decimation nor density value distribution is performed. This is because of density value distribution, i.e., the value distributed from the decimated pixel data increases the density value of the pixel data corresponding to the nozzles N3, N5, N7, and N9 from the value range for the dot size of "small" or "medium" to the value range for the dot size of "medium" or "large". Note here that FIG. 12A shows the ideal dot formation result on the printing medium based on the normal printing data generated from the image data not having been subjected to data decimation process or density value distribution, achieved by the correct black nozzle module 50 free from faulty nozzle causing ink deflection. From a macroscopic viewpoint, compared with such an ideal printing result of FIG. 12A, in the printing result of FIG. 12C, the image texture is not smooth that much. However, compared with the printing result of FIG. 12B with no consideration to ink deflection, the phenomenon acknowledged as white and dark streaks can be made less noticeable.

In the first embodiment described above, the image data acquisition section 10 corresponds to the image data acquisition unit of the first or thirty-second aspects. The nozzle information storage section 14 corresponds to the nozzle information storage unit of any one of the aspects of first, thirteenth, twenty-third, thirty-second, forty-first, and fifty-first. The printing nozzle selection section 12 and the printing data generation section 18 correspond to the printing data generation unit of any one of the aspects of first, seventh, eighth, ninth, thirty-second, thirty-eighth, thirty-ninth, and fortieth. The printing section 20 corresponds to the printing unit of the first aspect.

In the first embodiment described above, step S102 corresponds to the image data acquiring of any one of the aspects of thirteenth, twenty-third, forty-first, and fifty-first. Steps S106 and S110 correspond to the printing data generating in any one of the aspects of thirteenth, nineteenth, twentieth, twenty-first, twenty-third, twenty-ninth, thirtieth, thirty-first, forty-first, forty-seventh, forty-eighth, forty-ninth, fifty-sixth, fifty-seventh, fifty-eighth, and fifty-ninth. Step S112 corresponds to the printing of the thirteenth or twenty-third aspects.

Second Embodiment

Figure 13:
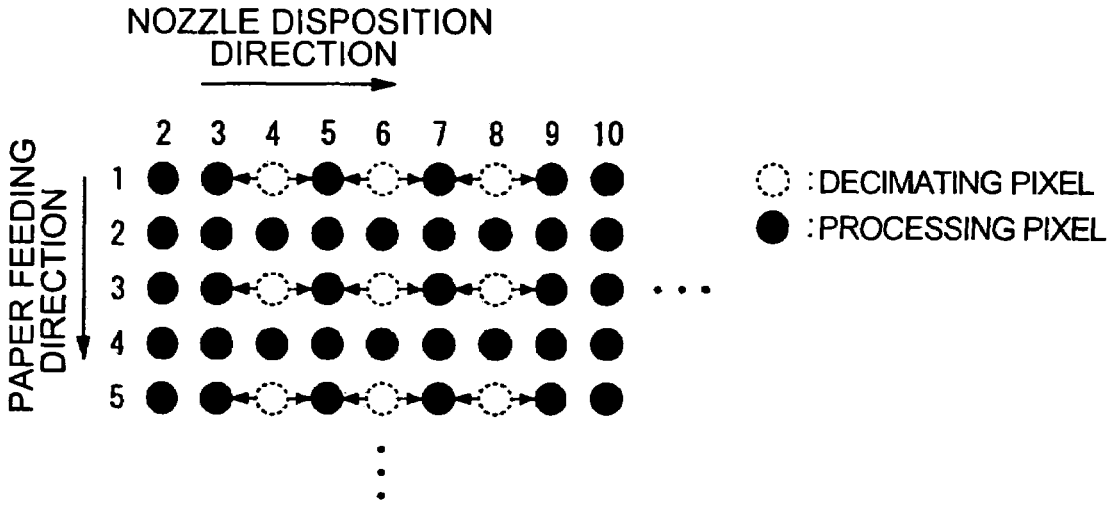
FIG. 13 is a diagram showing an exemplary pixel data decimation process in a case where a not-to-be-used nozzle is set for every other line of the image data.
Figure 14:
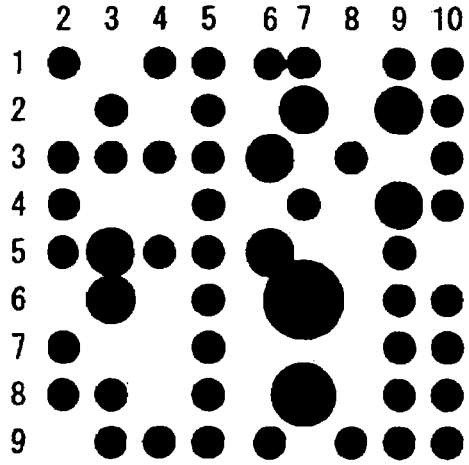
FIG. 14 is a diagram showing an exemplary dot pattern to be formed only by the black nozzle module 50 including a faulty nozzle in the case of FIG. 13.

Described next is a second embodiment of the invention by referring to the accompanying drawings. FIGS. 13 and 14 are both diagrams showing the second embodiment of the invention, i.e., a printing device, a printing device control program and method, and a printing data generation device, program, and method.

The second embodiment is different from the first embodiment in the respect that a nozzle disuse setting is made for every other line of the image data. In the following, only the differences from the first embodiment are described thereby avoiding redundant description.

In step S202, based on the analysis result of step S200 and the nozzle characteristics information read from the nozzle information storage section 14, the printing nozzle setting section 12 makes a setting of whether the pixel data of a predetermined region is used with the corresponding nozzle N. After such setting-making, the procedure goes to step S204. In the present embodiment, a nozzle disuse setting is made for the pixel data corresponding to a faulty nozzle causing ink deflection, i.e., every other line of the image data. Another setting is also made that a nozzle not on the immediate right of the faulty nozzle but with a nozzle disposed therebetween, and a nozzle not on the immediate left of the faulty nozzle with a nozzle disposed therebetween are not to be used for the corresponding pixel data. More in detail, assuming that the faulty nozzle is determined as not to be used for the pixel data of the corresponding image data, i.e., odd-numbered lines of 1, 3, 5, 7, and others. In such a case, a setting is so made that the faulty nozzle is to be used for the even-numbered lines of 2, 4, 6, and others of the pixel data corresponding to the faulty nozzle.

By referring to FIGS. 13 and 14, described next is the operation of the present embodiment.

FIG. 13 is a diagram showing an exemplary pixel data decimation process in a case where a not-to-be-used nozzle is set for every other line of the image data. FIG. 14 is a diagram showing an exemplary dot pattern to be formed only by the black nozzle module 50 including a faulty nozzle in the case of FIG. 13.

When the image data acquisition section 10 receives printing command information from any external device (step S100), the printing device 100 acquires image data corresponding to the printing command information from the external device or others being the source of the information. The acquired image data is forwarded to the printing nozzle setting section 12 (step S102) The printing nozzle setting section 12 reads nozzle characteristics information from the nozzle information storage section 14 (step S104), and selects the pixel data of the predetermined region from the acquired image data (step S106). Referring to the selected pixel data of the predetermined region and the read nozzle characteristics information, in the black nozzle module 50 of the printing head 200, the printing nozzle setting section 12 determines whether the pixel data of the predetermined region corresponds to the faulty nozzle of the printing head 200 causing ink deflection (step S108). If the data corresponds to the faulty nozzle, the procedure moves to the printing data generation process with ink deflection considered (step S110).

In the printing data generation process with ink deflection considered, first of all, the printing nozzle setting section 12 goes through a process of decimating, from the pixel data of the predetermined region, the pixel data corresponding to the faulty nozzle causing ink deflection, and the pixel data corresponding to any of the neighboring nozzles. This data decimation is performed based on the pixel data of the predetermined region, and the nozzle characteristics information. In this example, similarly to the above first embodiment, a case is assumed where the nozzle N6 in the black nozzle module 50 is causing ink deflection, and the printing result derived by the black nozzle module 50 looks as shown in FIG. 9A, i.e., the dots formed by the nozzle N6 are displaced by the distance a toward the dots formed by the nozzle N7. The distance between the nozzles N5 and N6 looks thus wider than usual, and the distance between the nozzles N6 and N7 looks narrower than usual.

The printing nozzle setting section 12 thus analyzes the pixel data of the predetermined region based on the nozzle characteristics information (step S200). As shown in FIG. 13, the printing nozzle setting section 12 makes a nozzle disuse setting against the odd-numbered lines, i.e., 1, 3, 5, and others, of the pixel data of the predetermined region, not to use the nozzle N6 causing ink deflection, and the nozzles N4 and N8 located on both sides of the faulty nozzle N6, not immediately but with the nozzles N5 and N7 respectively disposed therebetween (step S202). Based on such setting details, the printing nozzle setting section 12 decimates the pixel data corresponding to such not-to-be-used nozzles from the predetermined region of the selected image data. More in detail, as to the image data including a plurality of pixel data in a matrix, in the predetermined region including the pixel data corresponding to the faulty nozzle, a nozzle disuse setting is made against the pixel data of the odd-numbered lines, and no such nozzle disuse setting is made against the pixel data of the even-numbered lines. At the time of data decimation, similarly to the first embodiment, the printing nozzle setting section 12 also executes a process of distributing the density value of the to-be-decimated pixel data among the pixel data on both sides thereof (steps S208 and S210). This value distribution is similar to that of the first embodiment, and thus is not described in detail again.

After the data decimation process and the density value distribution process, the resulting pixel data of the predetermined region is forwarded to the printing data generation section 18 for binarization therein (step S216). This binarization is similar to that of the first embodiment, and thus is not described in detail again.

After such data decimation and density value distribution, when every pixel data of the predetermined region is through with binarization (step S218), and when the pixel data of every region of the image data is through therewith (step S112), the image data having been subjected to binarization is forwarded to the printing section 20 as the printing data (step S114).

Based on the printing data thus provided by the printing data generation section 18, the printing section 20 uses the black nozzle module 50 to perform dot formation (printing) on a printing medium (step S116). As shown in FIG. 14, in the formation result, no dot is formed on the odd-numbered lines of the image data for the nozzles N4, N6, and N8, and the dots at the positions corresponding to the adjacent nozzles N3, N5, N7, and N9 are bigger than the formation result of FIG. 12B. That is, the formation result of FIG. 12B is derived for the case where the printing data is generated in a normal manner with no consideration for the fact that nozzle N6 is causing ink deflection, i.e., neither data decimation nor density value distribution is performed. On the other hand, as shown in FIG. 14, on the even-numbered lines of the image data, the dots corresponding to the nozzles N4, N6, and N8 are of the similar size as those in the dot pattern of FIG. 12B. This is because of density value distribution, and its reason is not described here again as is being similar in the first embodiment.

From a macroscopic viewpoint, compared with such an ideal printing result of FIG. 12A, in the printing result of FIG. 14, the image texture is not smooth that much. However, compared with the printing result of FIG. 12B with no consideration to ink deflection, the phenomenon acknowledged as white and dark streaks can be made less noticeable. The white streaks can be made much less noticeable than the printing result of FIG. 12C because the dots on the even-numbered lines are not decimated but left.

In the second embodiment described above, the image data acquisition section 10 corresponds to the image data acquisition unit of the first or thirty-second aspects. The nozzle information storage section 14 corresponds to the nozzle information storage unit of any one of the aspects of first, thirteenth, twenty-third, thirty-second, forty-first, and fifty-first. The printing nozzle selection section 12 and the printing data generation section 18 correspond to the printing data generation unit of any one of the aspects of first, second, sixth, seventh, eighth, ninth, thirty-second, thirty-third, thirty-seventh, thirty-eighth, thirty-ninth, and fortieth. The printing section 20 corresponds to the printing unit of the first aspect.

In the second embodiment described above, step S102 corresponds to the image data acquiring of any one of the aspects of thirteenth, twenty-third, forty-first, and fifty-first. Steps S106 and S108 correspond to the printing data generating in any one of the aspects of thirteenth, fourteenth, eighteenth, nineteenth, twentieth, twenty-first, twenty-third, twenty-fourth, twenty-eighth, twenty-ninth, thirtieth, thirty-first, forty-first, forty-second, forty-sixth, forty-seventh, forty-eighth, forty-ninth, fifty-first, fifty-second, fifty-sixth, fifty-seventh, fifty-eighth, and fifty-ninth. Step S112 corresponds to the printing of the thirteenth or twenty-third aspects.

Third Embodiment

Figure 15:
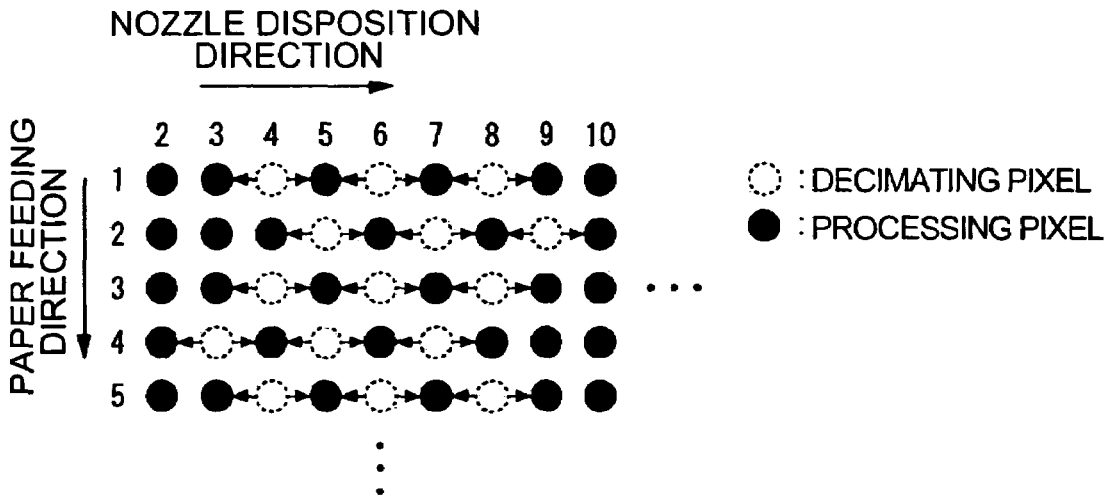
FIG. 15 is a diagram showing an exemplary pixel data decimation process in a case where a not-to-be-used nozzle is set at any random position for every line of the image data.
Figure 16:
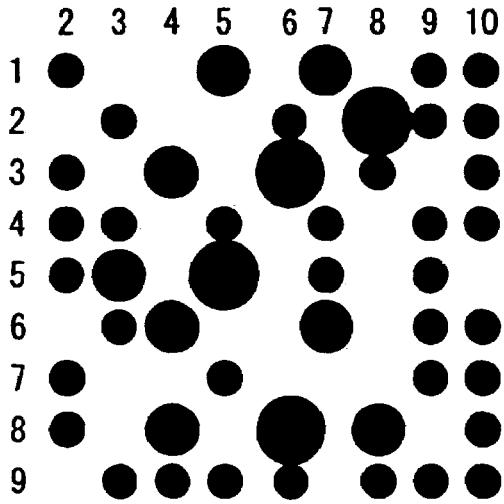
FIG. 16 is a diagram showing an exemplary dot pattern to be formed only by the black nozzle module 50 including a faulty nozzle in the case of FIG. 15.
Figure 17:
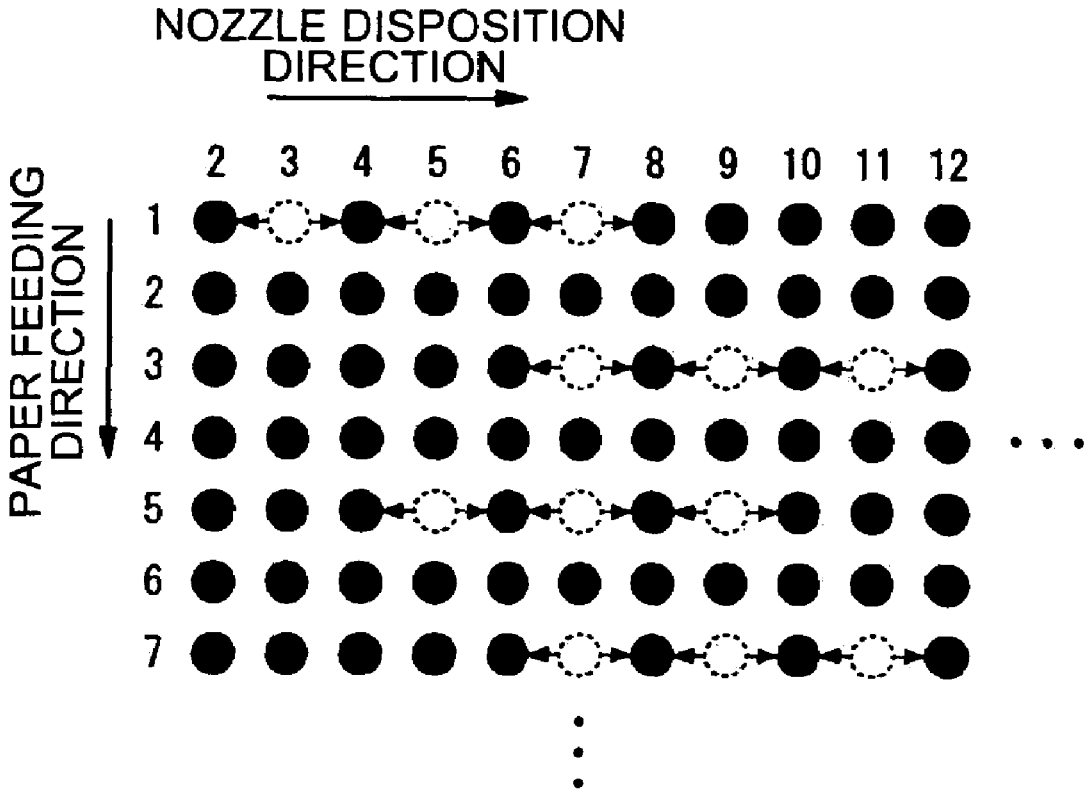
FIG. 17 is a diagram showing an exemplary pixel data decimation process in a case where a not-to-be-used nozzle is set at any random column position for every other line of the image data.

Described next is a third embodiment of the invention by referring to the accompanying drawings. FIGS. 15 to 17 are all diagrams showing the third embodiment of the invention, i.e., a printing device, a printing device control program and method, and a printing data generation device, program, and method.

The third embodiment is different from the first and second embodiments in the respect that a nozzle disuse setting is made by selecting not-to-be-used nozzles at random from a faulty nozzle and its neighboring nozzles for every line of the image data. In the following, only the differences from the first and second embodiments are described thereby avoiding redundant description.

In step S202, based on the analysis result of step S200 and the nozzle characteristics information read from the nozzle information storage section 14, the printing nozzle setting section 12 makes a setting of whether the pixel data of a predetermined region of the image data is used with the corresponding nozzle N. After such setting-making, the procedure goes to step S204. In the present embodiment, a nozzle disuse setting is made against the pixel data corresponding to the faulty nozzle causing ink deflection, and pixel data corresponding to any of the neighboring nozzles of the faulty nozzle, for every line of the pixel data of the predetermined region. A nozzle selection is made at random for this purpose. That is, unlike the first embodiment, a setting is so made that the pixel data using no nozzle is not necessarily located on the same line, and such pixel data is located at each different column position of the lines.

By referring to FIGS. 15 to 17, described next is the operation of the present embodiment.

FIG. 15 is a diagram showing an exemplary pixel data decimation process in a case where a not-to-be-used nozzle is set at any random column position for every line of the image data. FIG. 16 is a diagram showing an exemplary dot pattern to be formed only by the black nozzle module 50 including a faulty nozzle in the case of FIG. 15. FIG. 17 is a diagram showing an exemplary pixel data decimation process in a case where a not-to-be-used nozzle is set at any random column position for every other line of the image data.

When the printing data acquisition section 10 receives printing command information from any external device (step S100), the printing device 100 acquires image data corresponding to the printing command information from the external device or others being the source of the information. The acquired image data is forwarded to the printing nozzle setting section 12 (step S102). The printing nozzle setting section 12 reads nozzle characteristics information from the nozzle information storage section 14 (step S104), and selects the pixel data of the predetermined region from the acquired image data (step S106). Referring to the selected pixel data of the predetermined region and the read nozzle characteristics information, in the black nozzle module 50 of the printing head 200, the printing nozzle setting section 12 determines whether the pixel data of the predetermined region corresponds to the faulty nozzle causing ink deflection (step S108). If the data corresponds to the faulty nozzle, the procedure moves to the printing data generation process with ink deflection considered (step S110).

In the printing data generation process with ink deflection considered, first of all, the printing nozzle setting section 12 goes through a process of decimating, from the pixel data of the predetermined region, the pixel data corresponding to the faulty nozzle causing ink deflection, and the pixel data corresponding to any of the neighboring nozzles. This data decimation is performed based on the pixel data of the predetermined region of the image data, and the nozzle characteristics information. In this example, similarly to the first embodiment, a case is assumed where the nozzle N6 in the black nozzle module 50 is causing ink deflection, and the printing result derived by the black nozzle module 50 looks as shown in FIG. 9A, i.e., the dots formed by the nozzle N6 are displaced by the distance a toward the dots formed by the nozzle N7. The distance between the nozzles N5 and N6 looks thus wider than usual, and the distance between the nozzles N6 and N7 looks narrower than usual.

The printing nozzle setting section 12 thus analyzes the pixel data of the predetermined region in the image data based on the nozzle characteristics information (step S200). As shown in FIG. 15, the not-to-be-used nozzles are the nozzles N4, N6, and N8 for the first line of the image data. For the second line of the image data, the not-to-be-used nozzles are the nozzles N5, N7, and N9, and for the third line of the image data, the not-to-be-used nozzles are the nozzles N4, N6, and N8. For the fourth line of the image data, the not-to-be-used nozzles are the nozzles N3, N5, and N7, and for the fifth line of the image data, the not-to-be-used nozzles are the nozzles N4, N6, and N8. As such, a setting is so made that the not-to-be-used nozzles N are selected from those at random column positions for every line (step S202). In the present embodiment, the number of nozzles to be set as the not-to-be-used nozzle is three.

Based on such a nozzle disuse setting, the printing nozzle setting section 12 decimates the pixel data corresponding to such not-to-be-used nozzles from the selected pixel data of the predetermined region. At this time, the printing nozzle setting section 12 also executes a process of distributing the density value of the to-be-decimated pixel data among the pixel data on both sides thereof (steps S208 and S210). This value distribution is similar to that of the first embodiment, and thus is not described in detail again.

After the data decimation process and the density value distribution process, the pixel data of the predetermined region is forwarded to the printing data generation section 18 for binarization therein (step S216). This binarization is similar to that of the first embodiment, and thus is not described in detail again.

After such data decimation and density value distribution, when every pixel data of the predetermined region is through with binarization (step S218), and when the pixel data of every region of the image data is through therewith (step S112), the image data having been subjected to binarization is forwarded to the printing section 20 as the printing data (step S114).

Based on the printing data thus provided by the printing data generation section 18, the printing section 20 uses the black nozzle module 50 to perform dot formation (printing) on a printing medium (step S116). As shown in FIG. 16, in the formation result, no dot is formed for the nozzles N4, N6, and N8 on the odd-numbered lines of the image data, i.e., 1, 3, 5, 7, and 9. The dots at the positions corresponding to the adjacent nozzles N3, N5, N7, and N9 are bigger than the formation result of FIG. 12B. That is, the formation result of FIG. 12B is derived for the case where the printing data is generated in a normal manner with no consideration for the fact that nozzle N6 is causing ink deflection, i.e., neither data decimation nor density value distribution is performed. Further, as shown in FIG. 16, in the second and sixth lines of the image data, no dot is formed for the nozzles N5, N7, and N9, and the dots at the positions corresponding to the adjacent nozzles N4, N6, and N8 are bigger than the formation result of FIG. 12B. Still further, as shown in FIG. 16, in the fourth and eighth lines of the image data, no dot is formed for the nozzles N3, N5, and N7, and the dots at the positions corresponding to the adjacent nozzles N2, N4, and N6 are bigger than the formation result of FIG. 12B.

This is because of density value distribution, and its reason is not described here again since it is similar to the first embodiment.

From a macroscopic viewpoint, compared with such an ideal printing result of FIG. 12A, in the printing result of FIG. 16, the image texture is not smooth that much. However, compared with the printing result of FIG. 12B with no consideration to ink deflection, the phenomenon acknowledged as white and dark streaks can be made less noticeable. The white streaks can be made much less noticeable than the printing result of FIG. 12C because the dots are decimated at random.

As shown in FIG. 17, the not-to-be-used nozzles may be set at random column positions, every other line of the pixel data of the predetermined region of the image data. In FIG. 17 example, the not-to-be-used nozzles are the nozzles N4, N6, and N8 for the first line of the image data. For the third line of the image data, the not-to-be-used nozzles are the nozzles N6, N8, and N10, and for the fifth line of the image data, the not-to-be-used nozzles are the nozzles N5, N7, and N9. For the seventh line of the image data, the not-to-be-used nozzles are the nozzles N7, N9, and N11. No such nozzle disuse setting is made to the even-numbered lines of the pixel data but to every odd-numbered line of the pixel data at random column positions. As such, by going through data decimation, and density value distribution and binarization in a similar manner to the above, compared with the printing result of FIG. 12B with no consideration to ink deflection, the phenomenon acknowledged as white and dark streaks can be made less noticeable.

In the third embodiment described above, the image data acquisition section 10 corresponds to the image data acquisition unit of the first or thirty-second aspects. The nozzle information storage section 14 corresponds to the nozzle information storage unit of any one of the aspects of first, thirteenth, twenty-third, thirty-second, forty-first, and fifty-first. The printing nozzle selection section 12 and the printing data generation section 18 correspond to the printing data generation unit of any one of the aspects of first, third, fourth, fifth, sixth, seventh, eighth, ninth, thirty-second, thirty-fourth, thirty-fifth, thirty-sixth, thirty-seventh, thirty-eighth, thirty-ninth, and fortieth. The printing section 20 corresponds to the printing unit of the first aspect.

In the third embodiment, step S102 corresponds to the image data acquiring of any one of the aspects of thirteenth, twenty-third, forty-first, and fifty-first. Steps S106 and S108 correspond to the printing data generating in any one of the aspects of thirteenth, fifteenth, sixteenth, seventeenth, eighteenth, nineteenth, twentieth, twenty-first, twenty-third, twenty-fifth, twenty-sixth, twenty-seventh, twenty-eighth, twenty-ninth, thirtieth, thirty-first, forty-first, forty-third, forty-fourth, forty-fifth, forty-sixth, forty-seventh, forty-eighth, forty-ninth, fifty-first, fifty-third, fifty-fourth, fifty-fifth, fifty-sixth, fifty-seventh, fifty-eighth, and fifty-ninth. Step S112 corresponds to the printing of the thirteenth or twenty-third aspects.

The invention is characterized in the respect that image data is converted into printing data with consideration given to the characteristics of a printing head without tailoring any existing printing device. Accordingly, there is no need to provide any specific component serving as the printing section 20, but an ink jet printer that has been on the market can be used as it is. What is more, by separating the printing section 20 from the printing device 100 of the invention, the component function can be implemented by only a general-purpose printing command terminal (printing data generation unit) such as PCs.

The invention is not only for an ink deflection problem but is also surely applicable to a problem of causing the same phenomenon as the ink deflection to dots to be formed, which results from the nozzles not at their ideal positions even if the ink discharge direction is perpendicular, i.e., correct. The invention is surely also applicable to an ink discharge failure from any specific nozzle, e.g., ink clogging. What is more, if there is any nozzle whose ink discharge amount is considerably different from others, the nozzle is set as not to be used as in the first embodiment so that the possible density unevenness can be favorably avoided.

The printing device 100 of the invention is applicable not only to line-head ink jet printers but also to multi-path ink jet printers (serial printers). With the line-head ink jet printers, even if an ink deflection problem is observed, the printing result can be derived by a single path with the high quality of white or dark streaks hardly noticeable. With the multi-path ink jet printers, the frequency of the reciprocating operation can be reduced so that the higher-speed printing can be achieved.

Figure 18A:
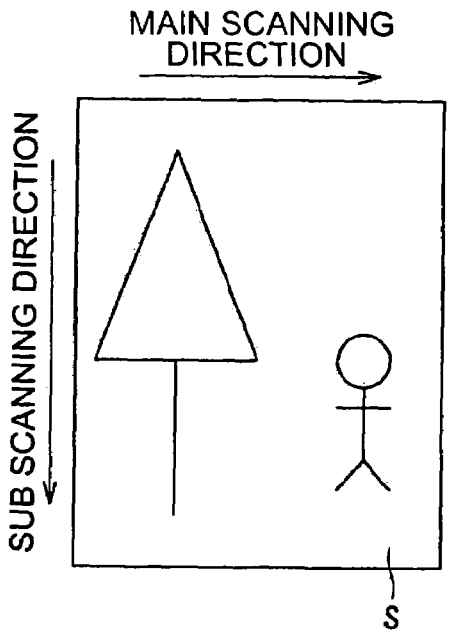
FIGS. 18A to 18C are all diagrams illustrating printing scheme differences between a multi-path ink jet printer, and a line head ink jet printer.
Figure 18B:
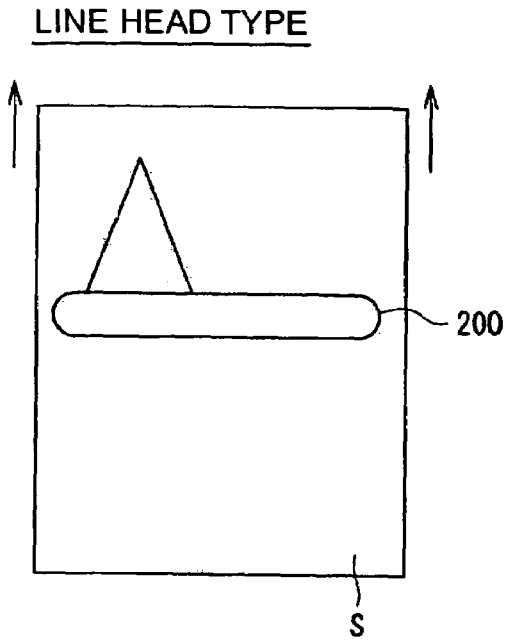
Figure 18C:
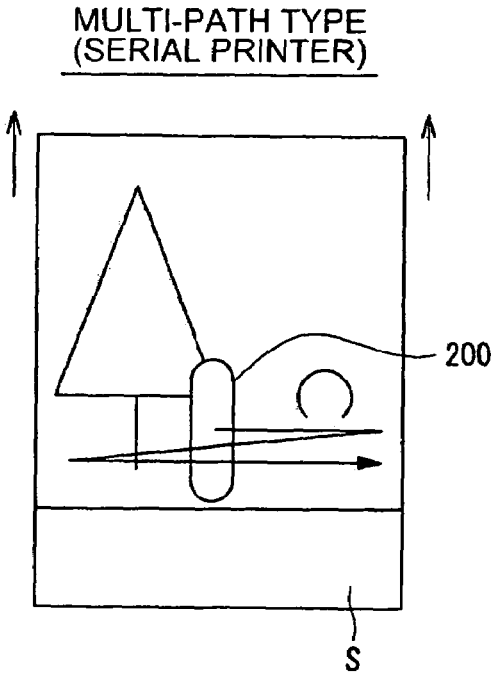

FIGS. 18A to 18C are all diagrams illustrating a printing scheme of a multi-path ink jet printer, and that of a line head ink jet printer.

As shown in FIG. 18A, it is assumed that the width direction of a rectangular printing paper P is the main scanning direction of the image data, and the longitudinal direction of the printing paper P is the sub scanning direction of the image data. By referring to FIG. 18B, the line-head ink jet printer is provided with the printing head 200 having the width of the printing paper P. The printing head 200 is fixed, and the printing paper P is moved with respect to the printing head 200 in the sub scanning direction so that the printing can be completed with a single scan, i.e., a single path operation. Alternatively, as a flat-head scanner, the printing paper P may be fixed, and the printing head 200 may be moved in the direction vertical to the nozzle disposition direction. Still alternatively, both the printing paper and the printing head may be moved in each opposite direction for printing. On the other hand, as shown in FIG. 12C, the multi-path ink jet printer is provided with the printer head 200 being rather short in width compared with the paper width. Such a printing head 200 is positioned in the direction orthogonal to the main scanning direction of the image, and is frequently reciprocated in the main scanning direction of the image so that the printing paper P is moved in the sub scanning direction of the image by a predetermined pitch for printing. As such, although the multi-path ink jet printer has a drawback of taking longer printing time compared with the line-head ink jet printer, it also has an advantage of correcting the above-described banding problem, specifically white streaks, to some extent due to its configuration of possibly placing the printing head 200 at any arbitrary position.

Exemplified in the above embodiments is an ink jet printer that performs printing by discharging ink in dots. This is not restrictive, and the invention is surely applicable to other types of printing device using a printing head provided with printing mechanisms in line, or thermal head printers called thermal transfer printers, thermal printers, and the like.

Figure 19:
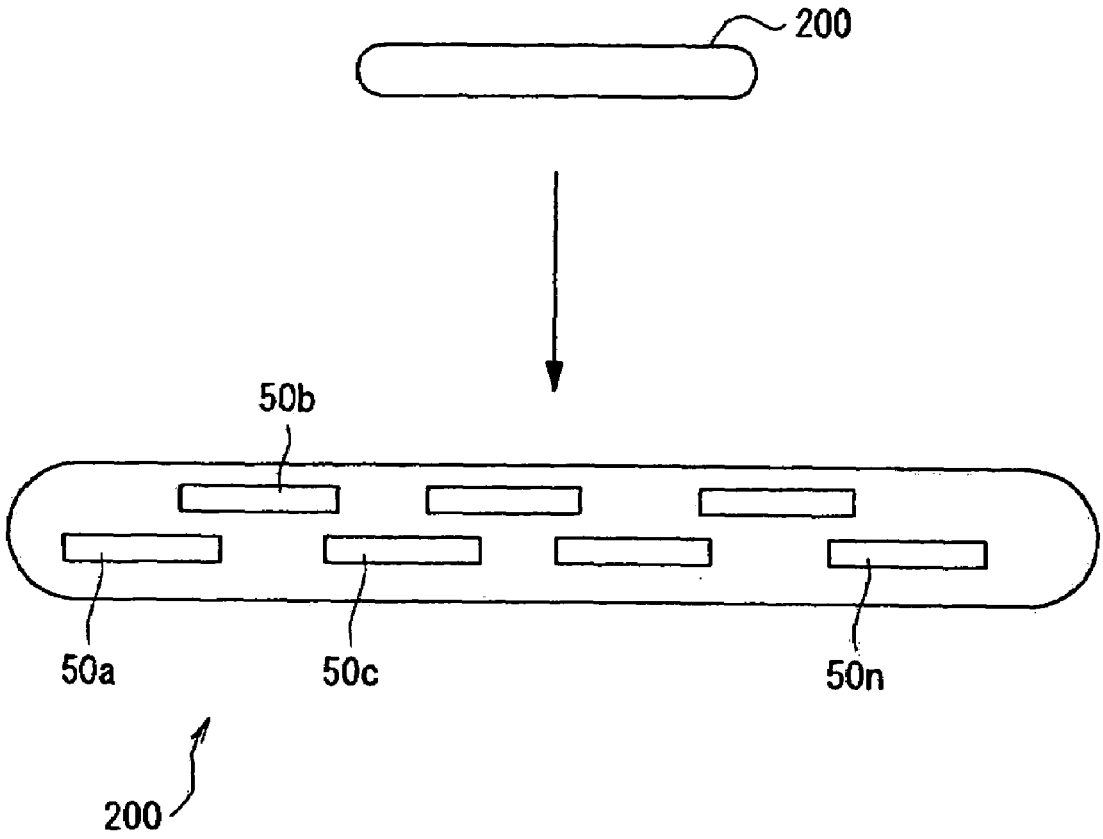
FIG. 19 is a conceptual view of another exemplary configuration of a printing head.

FIG. 3 shows the printing head 200 including the nozzles modules 50, 52, 54, and 56, discharging their corresponding color, and nozzle modules each carry nozzles N in line in the longitudinal direction of the printing head 200. As shown in FIG. 19, alternatively, the nozzle modules 50, 52, 54, and 56 may be configured by a plurality of short-length nozzle units 50*a*, 50*b*, . . . 50*n*, those of which are arranged in the movement direction of the printing head 200. Especially if the nozzle modules 50, 52, 54, and 56 are each configured by such short-length nozzle units 50*a*, 50*b*, . . . 50*n*, the resulting unit can be shorter in length. This favorably increases the productivity for the units, successfully suppressing the entire cost. What is more, by arranging many units, papers of larger size can be printed with ease.

Exemplified in the above embodiments is the printing device 100 including the nozzle characteristics detection section 16 to be ready for deterioration with time, or others. This is surely not restrictive, and the printing device 100 is not necessarily provided with the nozzle characteristics detection section 16. With this being the case, as an alternative to the nozzle characteristics information, used may be the detection result derived at the time of shipment, or the detection result derived after shipment using a specific detection unit or others provided separately from the printing device 100. The detected nozzle characteristics information is stored in the nozzle information storage section 14. Although such a configuration disables redetection of the nozzle characteristics when deterioration with time is observed or any data corruption occurs, the expensive devices such as scanners is not required any more for detecting the nozzle characteristics so that the cost can be effectively reduced to a considerable degree.

What is claimed is:

1. A printing device that prints a predetermined image onto a printing medium using a printing head that includes a plurality of nozzles each capable of dot formation to the printing medium, the printing device comprising:

an image data acquisition unit that acquires image data corresponding to a plurality of pixels of the image;

a printing data generation unit that generates, based on the acquired image data, printing data including information about dot formation details based on the pixels for each of the nozzles;

a nozzle information storage unit that stores information about any of the nozzles having dot formation details that are different from predetermined dot formation details; and a printing unit that prints, based on the printing data, the image onto the printing medium using the printing head, wherein by referring to the nozzle information storage unit for storage details therein, the printing data generation unit generates the printing data providing a lower resolution for the image to be printed by at least one of:

the nozzle of different dot formation details; and any neighboring nozzles;

as compared with a resolution of the image data acquired by the image data acquisition unit corresponding to the nozzle used for printing;

and wherein with respect to values of the pixels of the image data corresponding to the nozzle of different dot formation details and the any neighboring nozzles, the printing data generation unit selects, for every line of the image, the nozzle of different dot formation details and the any other neighboring nozzles for exclusion from use for printing the image of the image data, and generates the printing data based on the values of the pixels of the image data corresponding to the selected nozzles.

2. The printing device according to claim 1, wherein when selecting the any neighboring nozzles of different dot formation details for exclusion from use, the printing data generation unit makes the selection from a random position for every line of the image.

3. The printing device according to claim 1, wherein the printing data generation unit selects, for exclusion from use, the nozzle of different dot formation details and the any neighboring nozzles to alternately switch, for every predetermined line of the image, between two states of using at least one of the nozzle of different dot formation details or the any neighboring nozzles.

4. The printing device according to claim 1, wherein the printing data generation unit selects, for exclusion from use, the nozzle of different dot formation details and the any other neighboring nozzles to establish a positional relationship in which a dot to be formed by the any neighboring nozzles comes on the same line as a dot to be formed by the nozzle of different dot formation details with one or more dots disposed therebetween.

5. The printing device according to claim 1, wherein the printing head is configured by the nozzles being successively disposed over a region wider than a region with the printing medium being attached.

6. The printing device according to claim 1, wherein the printing head is configured by the nozzles being disposed in a direction perpendicular to a paper feeding direction of the printing medium for printing with a single scan.

7. The printing device according to claim 1, wherein the printing head takes charge of printing while reciprocating in a direction perpendicular to a paper feeding direction of the printing medium.

8. A printing device that prints a predetermined image onto a printing medium using a printing head that includes a plurality of nozzles each capable of dot formation to the printing medium, the printing device comprising:

an image data acquisition unit that acquires image data corresponding to a plurality of pixels of the image;

a printing data generation unit that generates, based on the acquired image data, printing data including information about dot formation details based on the pixels for each of the nozzles;

a nozzle information storage unit that stores information about any of the nozzles having dot formation details that are different from predetermined dot formation details; and a printing unit that prints, based on the printing data, the image onto the printing medium using the printing head, wherein by referring to the nozzle information storage unit for storage details therein, the printing data generation unit generates the printing data providing a lower resolution for the image to be printed by at least one of:

the nozzle of different dot formation details; and any neighboring nozzles;

as compared with a resolution of the image data acquired by the image data acquisition unit corresponding to the nozzle used for printing wherein with respect to values of the pixels of the image data corresponding to the nozzle of different dot formation details and the any neighboring nozzles, the printing data generation unit selects, from a predetermined line position of the image, the nozzle of different dot formation details and the any neighboring nozzles for exclusion from use for printing the image of the image data.

9. A printing device that prints a predetermined image onto a printing medium using a printing head that includes a plurality of nozzles each capable of dot formation to the printing medium, the printing device comprising:

an image data acquisition unit that acquires image data corresponding to a plurality of pixels of the image;

a printing data generation unit that generates, based on the acquired image data, printing data including information about dot formation details based on the pixels for each of the nozzles;

a nozzle information storage unit that stores information about any of the nozzles having dot formation details that are different from predetermined dot formation details; and a printing unit that prints, based on the printing data, the image onto the printing medium using the printing head, wherein by referring to the nozzle information storage unit for storage details therein, the printing data generation unit generates the printing data providing a lower resolution for the image to be printed by at least one of:

the nozzle of different dot formation details; and any neighboring nozzles;

as compared with a resolution of the image data acquired by the image data acquisition unit corresponding to the nozzle used for printing, wherein the printing data generation unit generates the printing data in which a portion of the image to be printed with the lower resolution shows a dithering level equivalent to that of the image before the resolution is reduced; and wherein based on values of the pixels of the image data corresponding to the nozzles for exclusion from use, the printing data generation unit corrects the values of the pixels of the image data corresponding to any nozzles adjacent to the nozzles for exclusion from use, and generates the printing data based on the values of the pixels of the corrected image data.

10. The printing device according to claim 9, the printing data generation unit generates the printing data in which a dot to be formed by at least one of the nozzle of different dot formation details and the any neighboring nozzles is larger in size than a dot before the resolution is reduced with respect to the values of the pixels of the image data corresponding to the nozzle.

* * * * *